US012358668B2

(12) United States Patent
Haidacher et al.

(10) Patent No.: US 12,358,668 B2
(45) Date of Patent: Jul. 15, 2025

(54) METHOD, APPLICATION DEVICE, AND PACKAGING DEVICE FOR PRODUCING PACKAGING UNITS

(71) Applicant: Krones Aktiengesellschaft, Neutraubling (DE)

(72) Inventors: Peter Haidacher, Kiefersfelden (DE); Herbert Spindler, Niedermoosen (DE); Marcus Kreis, Kolbermoor (DE); Florian Saumweber, Rosenheim (DE)

(73) Assignee: Krones Aktiengesellschaft, Neutraubling (DE)

( * ) Notice: Subject to any disclaimer, the term of this patent is extended or adjusted under 35 U.S.C. 154(b) by 0 days.

(21) Appl. No.: 18/699,372

(22) PCT Filed: Sep. 8, 2022

(86) PCT No.: PCT/EP2022/074955
§ 371 (c)(1),
(2) Date: Apr. 8, 2024

(87) PCT Pub. No.: WO2023/061667
PCT Pub. Date: Apr. 20, 2023

(65) Prior Publication Data

US 2024/0409257 A1 Dec. 12, 2024

(30) Foreign Application Priority Data

Oct. 12, 2021 (DE) ..... 10 2021 126 396.4

(51) Int. Cl.
*B65B 17/02* (2006.01)
*B65B 13/02* (2006.01)
(Continued)

(52) U.S. Cl.
CPC ..... *B65B 13/022* (2013.01); *B65B 13/20* (2013.01); *B65B 17/025* (2013.01); *B65B 27/04* (2013.01)

(58) Field of Classification Search
CPC ..... B65B 17/025; B65B 13/20; B65B 13/022; B65B 13/02; B65B 27/04
See application file for complete search history.

(56) References Cited

U.S. PATENT DOCUMENTS 2,864,212 A * 12/1958 Bruce ..... B65B 61/207 53/157
2,929,181 A * 3/1960 Ougljesa ..... B65B 17/025 53/247
(Continued)

FOREIGN PATENT DOCUMENTS

DE 102019113179 A1 11/2020
DE 102019113181 A1 11/2020
(Continued)

OTHER PUBLICATIONS

PCT Application: PCT/EP2022/074955 Filed Sep. 8, 2022: International Preliminary Report on Patentability dated Apr. 25, 2024.
(Continued)

*Primary Examiner* — Andrew M Tecco
(74) *Attorney, Agent, or Firm* — Simmons Perrine Moyer Bergman PLC

(57) ABSTRACT

The invention relates to methods and devices for producing packaging units. Each of the packaging units has at least two articles which are held together by at least one strapping band and by at least one packaging blank. The method includes: providing the articles in a handling area of an application head; inserting a closed strapping band and a prepared packaging blank into the application head; feeding the application head to the articles, with the grouped articles being at least slightly compressed; positioning the strapping
(Continued)

band; securing the packaging blank to the articles; opening the application head while simultaneously releasing and separating the at least one strapping band from the fixed position of the strapping band within the application head; releasing and separating the at least one packaging blank; and removing the application head from the strapped article grouping combined by a packaging blank.

15 Claims, 13 Drawing Sheets

(51) Int. Cl.
*B65B 13/20* (2006.01)
*B65B 27/04* (2006.01)

(56) References Cited

U.S. PATENT DOCUMENTS 3,186,333 A * 6/1965 Hoffman ..... B65B 13/022 100/9
3,404,505 A * 10/1968 Hohl ..... B65B 27/04 53/399
3,509,684 A * 5/1970 Hohl et al. ..... B65B 17/025 53/142
3,708,950 A * 1/1973 Doucette ..... B65B 17/025 53/49
3,714,756 A * 2/1973 MacInnes ..... B65B 27/04 53/543
4,523,676 A * 6/1985 Barrash ..... B65D 71/506 206/428
5,775,486 A * 7/1998 Edqvist ..... B65D 71/42 53/399
5,791,121 A * 8/1998 Bernier ..... B65B 17/025 53/390
8,112,970 B2 * 2/2012 Marco ..... B65B 17/025 53/556
9,051,071 B2 * 6/2015 Perl ..... B65B 65/006
11,511,895 B1 * 11/2022 L'Heureux ..... B65B 57/16
2011/0056174 A1 * 3/2011 Perl ..... B65B 13/02 53/391
2014/0075885 A1 * 3/2014 Perl ..... B65B 13/02 53/399
2014/0216661 A1 * 8/2014 Sugimoto ..... B65C 3/08 156/443

FOREIGN PATENT DOCUMENTS

DE 102020207930 A1 12/2021
EP 1075419 B1 10/2003

OTHER PUBLICATIONS

PCT Application: PCT/EP2022/074955 Filed: Sep. 8, 2022—International Search Report and Written Opinion dated Feb. 24, 2023.
Priority Application: DE 10 2021 126 396.4 Filed: Oct. 12, 2021—German Search Report dated Feb. 28, 2023.

* cited by examiner

METHOD, APPLICATION DEVICE, AND PACKAGING DEVICE FOR PRODUCING PACKAGING UNITS

CLAIM OF PRIORITY

The present application claims priority to International Application PCT/EP2022/074955 dated Sep. 8, 2022, which in turn claims priority to German Application DE 10 2021 126 396.4 dated Oct. 12, 2021, which are incorporated by reference.

FIELD OF THE INVENTION

The present invention relates to a method, to an application device, and to a packaging device for producing packaging units according to the features of the independent claims.

BACKGROUND OF THE INVENTION

Various options are available to the user to combine individual articles into larger bundles. For example, beverage containers are usually combined and packaged using shrink films to form bundles of four, six or more beverage containers. The production of bundles is usually indispensable because they are the most common variant of sales units for beverage containers (such as bottles made of PET plastics material). In some cases, the containers are combined again for transport and/or assembled and palletized in layers.

The shrink films used to produce known bundles require certain manufacturing steps with relatively high energy consumption. In addition, the shrink film used incurs costs for producing, provision, handling as well as later disposal, since it is no longer required after sale. The machine configuration for providing the so-called film wrapping modules and other handling stations also incurs high investment costs. Finally, a relatively high investment of capital is also for the provision of the so-called shrink tunnel in which the shrink film wrapped around the bundle is shrunk around the bottles by hot air application.

As an alternative to this, strapping bundles are known in which a plurality of articles are held together by strapping that is stretched horizontally around the outer sides of the articles, which strapping is placed around the articles during an uninterrupted conveying process and is then fixed in place. The strapping is thereby made of at least one strip stretched around the outer sides of the articles and subsequently connected at its ends under pre-tension. For example, in continuous or cyclically operating strapping machines, containers, articles or bottles are grouped into formations and are then strapped with one or more bands using strapping assemblies. Typical formations can be, for example, 1×2 arrangements (two containers in a row), 2×2 arrangements (four containers in a square or diamond formation), 3×2, 4×3 or in principle also variable n×m arrangements.

The production of strapping bundles is described, for example, in German application no. DE 10 2009 040 700 A1.

The disadvantage here is that the strapping is connected to a closed strapping band on the articles. In particular, additional process time is required to produce a stable connection, which is a huge disadvantage with regard to the necessary production time and machine performance, especially in the case of continuous processing. In addition, any function required on the closer tool to produce the closed strapping increases the complexity of the packaging process and the tools used.

Furthermore, the use of so-called upper gripping cardboard packages is known, for example, to combine multiple bottles via their neck regions. A packaging machine for placing such upper gripping cardboard packages is described in the patent specification EP 1075419 B1. There, the articles are arranged in a crate, and the gripping cardboard package is placed on top of the at least one article arranged in the crate. In particular, a plurality of articles are arranged in the crate, and by placing a smaller number of upper gripping cardboard packages on top, subgroups are formed, each of which combines some of the articles arranged in the crate.

The object of the invention is to optimize a packaging process for producing packaging units, in particular to make it cost-effective, safe and fast.

SUMMARY OF THE INVENTION

The above object is achieved by a method, an application device, and a packaging device for producing packaging units, which have the features of the independent claims. Further advantageous embodiments are described by the dependent claims.

To achieve the above-mentioned objective, the invention proposes a method for producing packaging units having the features of the independent method claim. The packaging units produced using this method are each made of at least two grouped articles that are held together by at least one strapping band and by at least one packaging blank.

The strapping band can in particular be made of a paper material, a paper-like material, a plastics material, a composite material, or the like. The strapping band encircles the article group, wherein the strapping band is arranged in a tensioned manner around regions of the outer lateral surfaces of the articles. The strapping band has a circumference that provides sufficient band tension to hold together and stabilize the group of articles.

In contrast to the known prior art, in particular a closed strapping band is used, i.e., it is no longer necessary to make a connection between free end regions of the strapping material on the article group.

The articles to be combined are preferably containers filled with a liquid content, for example bottles or cans, in particular beverage containers. However, the bottles or cans or similar containers can also be filled, for example, with liquid cosmetics such as shampoo or the like.

The packaging blanks can in each instance preferably consist of a paper or cardboard material, a plastics material, a cardboard/plastics composite material or the like.

Each of the packaging blanks has passage openings for the articles combined over the packaging blank, wherein these passage openings correspond to longitudinal central axes of the articles to be combined and receive them as required, optionally with the production of a form-fit connection.

The method according to the invention has at least the following method steps:

First, at least two grouped articles are provided, which are positioned in a movement and/or handling area of an application head. At least one pre-assembled closed strapping band is inserted into this application head and fixed in a defined position. A cage of the application head has a variable opening width so that the cage can surround the grouped articles on the lateral side.

Furthermore, a prepared packaging blank is inserted into the application head, wherein this packaging blank is held in a defined position in the application head.

Subsequently, the application head equipped with the at least one strapping band and at least one packaging blank can be fed over the articles by a feeding movement, wherein the feed movement is approximately parallel to longitudinal central axes of the articles. During this feeding movement, the cage of the application head contacts the grouped articles at their lateral sides and ensures at least a slight compression of the contacted articles.

When reference is made to feeding the application head to the articles, this may mean lowering the application head equipped with the at least one strapping band over the articles. Alternatively, it can also describe a relative movement between the application head and the article group, which can take place by lifting the article group and threading it into the application head from below.

In this case, it is preferably provided that the compression applied to the lateral surfaces of the articles increases as the application head is lowered in a defined manner with increasing depth of the stroke until the desired compression is achieved. The stroke required for this purpose is defined, for example, by the design of a compression slope, described below, on contour pieces of the application head. As the downward movement progresses, the strapping band inserted into the application head is pushed over the compressed article group.

Of course, this also applies analogously if the article group is inserted into the application head by lifting it from below.

By defined feeding of the application head, which simultaneously compresses the articles, the strapping band is positioned at an intended position of the articles. In addition, the packaging blank is secured to the articles by defined feeding of the application head, which simultaneously compresses the articles.

The packaging blank is in each instance attached to the articles in such a way that the articles partially pass through the passage openings of the packaging blank and are thus held together by the packaging blank. In particular, the packaging blank is interlocked with the articles in this way.

For this purpose, the passage openings of the packaging blank can each have suitable fixing apparatuses that can be formed, for example, by fixing tabs. For example, fixing tabs are formed by notches or the like extending radially inward from the passage openings.

Particularly preferably, the packaging blank is in each instance secured to articles in such a way that the articles are each held in a clamping manner within a passage opening of the packaging blank in the region of an upper taper. In particular, bottles are held in a clamping manner below a so-called neck ring and cans are held in a clamping manner below a flanged edge forming the can edge, whereby an effective interlocking between the packaging blank and the articles is given in each instance.

After the strapping band and the packaging blank are secured to the articles, the opening width of the cage of the application head is increased, namely while simultaneously releasing and separating the at least one strapping band from its fixed position within the application head. In addition, the at least one packaging blank is released and separated from the application head.

Finally, the application head is removed from the strapped article group equipped with the packaging blank, and the application head is removed from the article grouping, thereby completing a packaging unit.

A particular advantage of the method according to the invention is the single-phase production of packaging units that are made by mechanically combining multiple grouped articles by two different fixing devices or packaging devices. Due to the simultaneous or almost simultaneous attachment of a strapping band, which surrounds the articles on the lateral side and holds them together, and of a packaging blank, which combines the articles on the top side, by a single application process, the production of the packaging units can on the one hand be carried out faster than before and with less synchronization effort within the packaging machine, because the article groups are simultaneously ready for the attachment of the packaging blank and are precisely positioned, so that multiple coordination of different application devices with one another or with the articles to be packaged is unnecessary.

In one variant of the method according to the invention, the compression of the cage is released once the strapping band is stripped and is attached to the article grouping at its intended target position and is positioned there with the intended pre-tension. In this way, the strapping band tension can be adjusted by the elastic restoring forces of the compressible articles, without requiring additional devices to apply an intended band tension and/or to connect the two open band ends.

In addition, the holder or fixing of the packaging blank can be released once the packaging blank is secured to the articles in a defined position. Since the positioning of the article group in the cage of the application unit already ensures the precise alignment and securing of the relative positions of the packaging blank and the articles to be applied with it, the packaging blank can be precisely positioned and applied to the articles in connection with the application of the strapping band.

The method can preferably provide that the strapping band is positioned at an intended position on the articles and the packaging blank is secured to the articles simultaneously or virtually simultaneously.

In an alternative method variant, however, it can optionally also be provided that the strapping band is positioned at an intended position on the articles and the packaging blank is secured to the articles in a temporally offset manner.

In both method variants, however, the positioning of the article group within the cage of the application unit ensures the precise alignment of the articles so that the packaging blank can easily be applied at the intended location, regardless of whether this takes place simultaneously with the application of the strapping band or in a slightly temporally offset manner.

In the method variants described, it can optionally be provided that a closed strapping band is previously produced from a strapping material provided in strip form and is positioned immediately thereafter in the application head. Pre-assembled strapping band portions are preferably produced, connected at their band ends and only then inserted into the application head. This allows the application head to be relatively simple in design, eliminating the need for band guide apparatuses and cutting and closing apparatuses.

Furthermore, the method can provide that individual printing is applied to the strapping material or to the strapping band before positioning in the application head and before the strapping band is inserted into the application head. Such a variable printing possibility opens up a wide range of applications to give the band a colored design, to apply product information in clear text or encoded form, etc.

Further tests have also shown that an additional position in the application head or within the cage can be favorable for inserting the banderole. In this case, the vertical flash face of the clamp moves slightly in the direction of the bundle center at the corners and sides so that the strapping band can always be reliably inserted behind the vertical flash face. Then, the clamps can be moved into their respective operating positions and the banderole can be clamped.

To achieve the above-mentioned objective, the present invention also proposes, in addition to the method described in various variants, an application device for producing packaging units, each of which is made of at least two grouped articles that are held together by at least one strapping band and by at least one packaging blank.

The application device is associated with a movement and/or handling area for an application head for cooperation with at least two articles grouped within the movement and/or handling area. The application head is designed to attach at least one strapping band and at least one packaging blank to an article group.

In addition, the application head comprises a cage having a variable opening width and a region for inserting at least one pre-assembled closed strapping band, wherein the cage can surround the grouped articles on the lateral side. Furthermore, the application head comprises at least one holding device for a packaging blank.

In particular, the cage is segmented and the opening width of the cage can be changed by feeding movements of the segments, in particular by opening movements of individual segments of the cage directed perpendicularly away from the lateral surface of the articles or perpendicularly to the article longitudinal axis, wherein a rotational movement and a combination of rotational and translational movements are also conceivable. As a result, after the band has been separated from the cage, the cage can be relatively easily separated from the strapped article group without compromising or damaging the packaging unit or any part of the packaging unit.

The application head together with the at least one strapping band fixed therein and the at least one held packaging blank can be lowered over the articles located in the movement area by a feeding movement, wherein the feed movement is approximately parallel to longitudinal central axes of the articles, and wherein the cage of the application head contacts the grouped articles on their lateral sides and at least slightly compresses them.

In addition, the cage of the application head can be opened while simultaneously releasing and separating the at least one strapping band from its fixed position within the application head.

Optionally, the cage of the application device can be equipped with fixing apparatuses for the strapping band, wherein the fixing apparatuses can in particular comprise clamping elements, suction elements, vacuum grippers or adhesive grippers. This allows the belt to be held reliably in place in the application device until it is located in its intended position on the article group. By using controllable clamping elements, suction elements, vacuum grippers or adhesive grippers, the band can then be separated from the application device so that it remains on the article group and can surround and hold it together to form the packaging unit.

In addition, the cage of the application device can have a contoured guide on its inner circumference, which is formed at the corner radii, and/or in which the inner contour of the cage is beveled in the lowering direction onto the article grouping. The contoured guide can be formed, for example, by the guiding or holding elements.

The fixing apparatuses and guiding or holding elements are in particular necessary for the correct placement and securing of the strapping band in the application head.

At least a part of the segments of the cage is preferably made up of contour pieces described below, which in particular form a part of the contoured guide.

In order to compress the articles during the strapping operation, the contour pieces are beveled in the feed direction, in particular in the lowering direction onto the article group or in the attachment direction, so that during the downward movement of the application head in the direction of the article longitudinal axis or during the upward movement of the grouped articles in the direction of the article longitudinal axis, a compression is exerted on the articles arranged in the application head, in the course of which the closed strapping band can be applied to the grouped articles.

The compression is released, for example, by an outwardly directed movement of the contour pieces. At the same time, the fixing of the strapping band in the application head is released so that the strapping band is wrapped around the outer lateral surfaces of the now loosened grouped articles. In addition, the packaging blank is released.

The outward movement of the contour pieces can thereby be radial to a center point of the application head. Alternatively, contour pieces arranged opposite one another can be removed from one another by an opposing movement.

In particular, in an operating mode, the application head has a first opening width that is at least in regions at least smaller than a width of the article group, so that the article group is at least slightly compressed. In contrast, the region of the application head in which the strapping band is arranged has a width that corresponds to the width of the uncompressed article group.

In a release mode, on the other hand, the application head has a second opening width that is greater than a width of the uncompressed article group and also greater than a width of the strapping band fixed in the application head, so that the strapped article group equipped with a packaging blank, which is also referred to below as a packaging unit, is released.

In particular, the contoured guidance of the cage provides the ring shape of the strapping band. Temporary fixing of the strapping band within the cage is necessary to keep it in position or in the required ring shape during the application process and to ensure correct pulling of the strapping band onto the article group. In this case, the fixing elements can either be distributed along the circumferential contour or are specifically located at distinctive points, for example in the region of the corner radii or the like.

For example, a contoured clamp having a vertical flash face or an undercut can be provided, in which undercut the strapping band is at least partially arranged. As a result, the strip is held reliably in the cage on the one hand, but can also easily be separated from the cage once it is positioned on the article group.

In addition, further tests have also shown that an additional position in the application head or within the cage can be favorable for inserting the sleeve. In this case, the vertical flash face of the clamp moves slightly in the direction of the bundle center at the corners and sides so that the strapping band can always be reliably inserted behind the vertical flash face. Then, the clamps can be moved into their respective operating positions and the banderole can be clamped. The same also applies to the packaging device described below, which works with such an application head for producing strapping bundles.

Finally, the present invention comprises a packaging device for producing packaging units, each of which is made of at least two grouped articles that are held together by at least one strapping band and at least one packaging blank, wherein the packaging device comprises an application device according to one of the embodiments described above.

The packaging device according to the invention also comprises a device for producing closed strapping bands, wherein this device has at least one magazine in which a supply of strapping material in strip form is provided, in particular on a roll as endless material. In addition, the device comprises a connection device for connecting free ends of the strapping material in strip form to form a closed strapping band.

The pre-production of the strapping band starting from an endless material is described below. When using pieces of strapping material already cut to length, the corresponding separation step is omitted. That is to say, the corresponding device does not require a separating apparatus described below.

The endless strapping material is supplied via a feed apparatus to a separating apparatus. The feed apparatus consists, for example, of two rubberized rollers, at least one of which is driven, and which unwind the endless strapping material accordingly. The separating apparatus consists, for example, of a downstream knife or other suitable cutting unit.

The separating apparatus cuts strapping material to a defined length, and the free end regions of the strapping material cut to length are connected to one another to form the ring-shaped, pre-assembled strapping band. In particular, the free end regions are thereby arranged partially overlapping and are connected to one another by gluing or a welding process or the like.

For example, the connection is made by a gluing unit comprising a glue application apparatus and a contact pressure apparatus to form an adhesive connection.

The gluing unit is preferably associated with a frame that maps the desired circumference of the strapping band to be formed in a recess along an inner or an outer circumference of the frame. The frame is associated with a circulating conveying unit.

The frame can, for example, be segmented and, by adjusting individual frame segments, the frame circumference can be adjusted and thus the circumference of the strapping band to be formed can be adjusted. This makes it possible to react to any circumferential variation of the article groups or to perform a format change with the same strapping material.

To transport the strapping material along an inner or an outer contour of the frame, one or more vacuum belts and/or mechanical conveying elements, for example circulating clamping elements, rubberized belts, conveyor belts, or the like can be used.

The strapping material is conveyed once around the entire inner or outer contour of the frame by the conveying unit until an overlap is formed in the region of the gluing unit.

The cut-to-length strip of strapping material is provided with glue at the starting region and/or at the end region by the glue application device and then pressed out by a contact pressure die of the contact pressure apparatus, thus creating a load-bearing connection.

The correspondingly closed strapping band can now be picked up by a transfer element in the manner described above and supplied to the application head of an application device for strapping an article group.

By integrating such a device for producing closed strapping bands into the packaging device, it is possible to react in an inline manner to changes in the circumference of the article groups. If the format changes, only the material needs to be changed if a different strapping material width is necessary. The costs for the preparation module are quickly recouped because strapping material provided on rolls is much less expensive than specially pre-assembled closed strapping bands.

In addition, in connection with the present invention, inline printing of the strapping material can be provided during the formation of a strapping band or during the application of the strapping band to the articles.

In particular, it is provided that a type of scattered print is applied as a basic print design on the strapping material. This is a printed image that repeats continuously at a defined interval. Ideally, the repeat interval is designed in such a way that it results in at least a complete repetition of the pattern per circumference of a closed strapping band for all formats to be processed, in particular bundle circumferences, in the corresponding width of the strapping material.

If, in addition, a bundle-specific print is to be present on the closed strapping band to be formed, an empty field is designed as a component of the scattered print. In this empty field, the desired printing can take place in an inline manner, for example in the form of a barcode, format information, best-before date, etc. For this purpose, in particular a printing unit arranged in the device for producing closed strapping bands can be provided, so that the desired printing takes place as part of the formation of the closed strapping band.

Alternatively, a corresponding printing unit can also be associated with the application device, wherein the printing can take place before the applied strapping band is applied to the grouped articles or after the packaging unit has been formed.

The inline print can be positioned within the empty fields by evaluating the unrolled length and back-calculating of the position of the empty field to be printed.

Alternatively, sensor detection of the empty field or other markings present on the strapping material can be provided. For example, the detection of a special geometric marking that is a component of the scattered print or the like is conceivable.

The advantage of inline printing is that it reduces the amount of strapping material required because it can now be used flexibly. This further reduces material costs because the same strapping material can be used for different products.

It should be expressly mentioned at this point that all aspects and embodiment variants which have been explained in connection with the device according to the invention can also relate to, or be, partial aspects of the method according to the invention. Therefore, if the description or the claim definitions pertaining to the device according to the invention make mention of certain aspects and/or correlations and/or effects, this applies equally to the method according to the invention. The same applies vice versa so that all aspects and embodiment variants which have been explained in connection with the method according to the invention can also relate to, or be, partial aspects of the device according to the invention. Therefore, if the description or the claim definitions pertaining to the method according to the invention make mention of certain aspects and/or correlations and/or effects, this applies equally to the device according to the invention.

BRIEF DESCRIPTION OF THE FIGURES

Exemplary embodiments of the invention and their advantages are explained in more detail below with reference to the accompanying figures. The proportions of the individual elements relative to one another in the figures do not always correspond to the actual proportions, since some forms are simplified, while other forms are shown enlarged in relation to other elements for better illustration.

Figure 2:
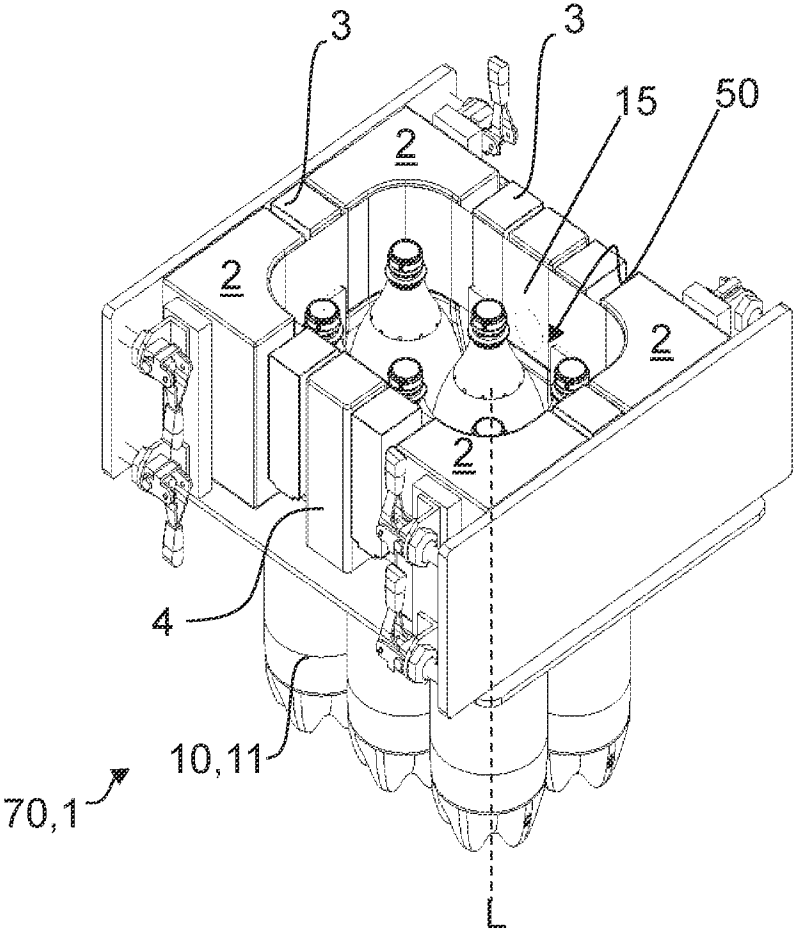
FIG. 2 shows an oblique perspective view from above of the strapping unit according to FIG. 1 with an article grouping arranged therein, which is to be strapped to produce a packaging unit.

Identical reference numerals are used for identical elements of the invention or those having the same effect. Furthermore, for the sake of clarity, only reference signs are shown in the individual figures, which are required for the description of the respective figure. The illustrated embodiments are merely examples of how the device according to the invention or the method according to the invention can be configured, and they are non-limiting.

DETAILED DESCRIPTION OF THE INVENTION

Figure 1:
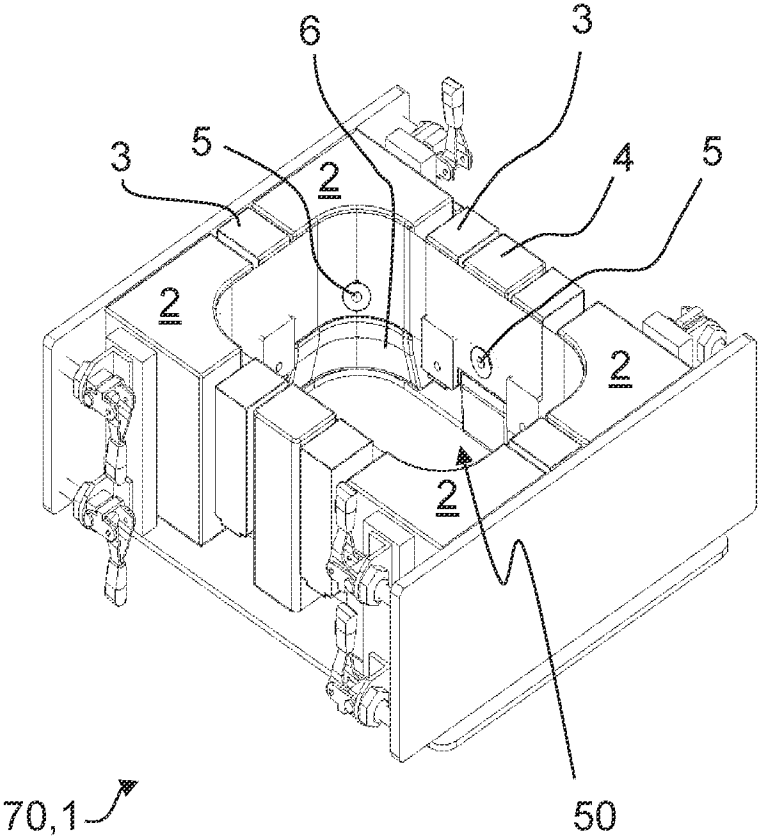
FIG. 1 shows an oblique perspective view from above of a strapping unit of an application head for producing packaging units.
Figure 4:
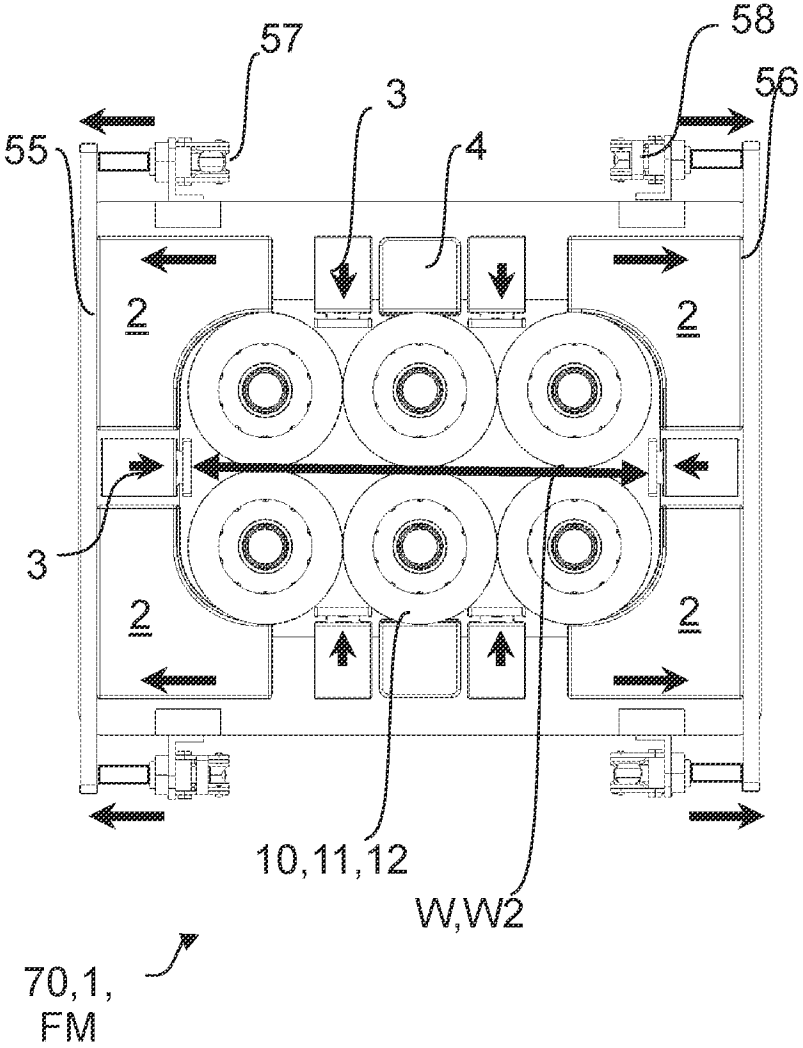
FIG. 3 to FIG. 5 show the strapping unit according to FIGS. 1 and 2, in each instance in representations from above.
Figure 3:
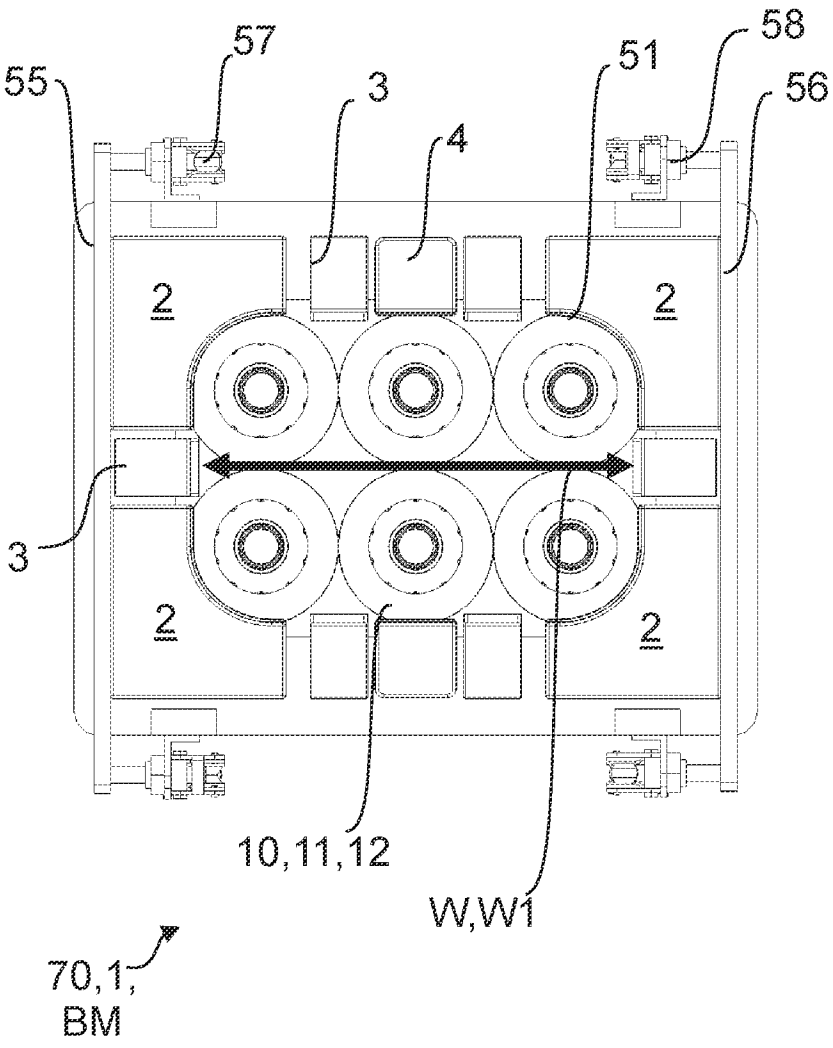
Figure 5:
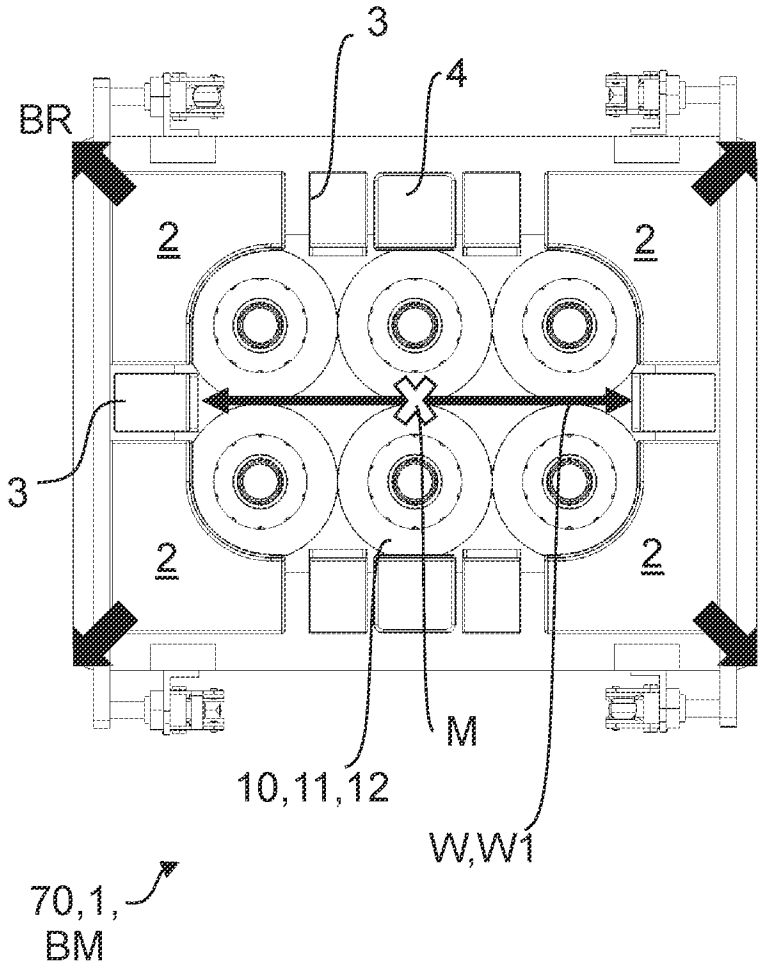

The perspective representations of FIGS. 1 and 2 each show a strapping unit 70 of an application head 1 for producing packaging units in oblique views from above. FIGS. 3 to 5 each show the strapping unit 70 according to FIGS. 1 and 2 in plan views from above.

The application head 1 shown by way of example in FIGS. 1 to 5 is provided and designed to attach at least one strapping band 15 to an article group 12 comprising at least two articles 10, wherein the strapping band 15 is attached to the outer lateral surfaces of the articles 10 in such a way that they are at least partially encircled by the strapping band 15, whereby the entire group 12 is also encircled and held together by the strapping band 15.

The strapping band 15, which holds the article group 12 together mechanically in this manner and is designed to be closed, can be formed in particular from a paper material, from a paper-like material, from a plastics material, from a composite material, or the like. The material and the material thickness of the strapping band 15 then depend on the mechanical stability that is to be ensured to hold the article group 12 together.

The articles 10 to be combined are preferably containers filled with a liquid content, for example bottles 11 or cans, in particular beverage containers. However, the bottles 11 or cans or similar containers can also be filled, for example, with liquid cosmetics such as shampoo or the like. The schematic representation of FIG. 2 shows that the bottles 11 can be, for example, plastics containers for holding beverages, in particular PET containers.

The application head 1 is also designed to additionally apply a packaging blank 60 to the articles 10 of the article group 12 in temporal connection with the application of the at least one strapping band 15 to the article group 12, as will be described in detail below in connection with FIGS. 6 to 12.

The strapping unit 70 shown here has a cage 50 having a variable opening width W that is variable by suitable actuators and that can completely surround the grouped articles 10 on the lateral side. In particular, the opening width W of the cage 50 can be changed by feeding movements of multiple contour pieces 2 that are connected to one another but adjustable in their relative positions to one another. These contour pieces 2 form at least a part of the segments from which the cage 50 is formed.

In addition, the strapping unit 70 comprises at least one contour piece 2 having a compression slope 6 designated as such here, the geometry of which is selected such that a downward movement of the strapping unit 70 in a direction parallel to the article longitudinal axes L or an upward movement of the article group 12 in a direction parallel to the article longitudinal axes L causes compression to be exerted on at least two grouped articles 10 (see FIGS. 2 and 4) arranged within the strapping unit 70 and in the course of which a closed, pre-produced strapping band 15 can be applied to the grouped articles 10. This means that the compression slopes 6 form a profile of the opening cross section of the cage 50 that is conical overall or extends toward a lower opening.

In the example shown, the cage 50 is formed by the contour pieces 2, the clamping elements 3 and the guiding or holding element 4. All of these parts are connected to one another, but can perform the relative movements described in more detail below relative to one another in order to be able to vary the opening width of the cage 50 as needed. In particular, the cage 50 has a contoured guide 51 on its inner circumference, which is formed in particular at the corner radii. Furthermore, the inner contour of the cage 50 is beveled in particular in the region of the contour elements 2 in the lowering direction onto the article group 12.

The strapping unit 70 is also equipped with clamping elements 3 and guiding or holding elements 4 and suction elements 5 located on the inside of the cage 50. These clamping elements 3, guiding or holding elements 4 and suction elements 5 are necessary in particular for correct placement and securing of the strapping band 15 within the strapping unit 70 (see FIG. 2).

The schematic plan views of FIGS. 3 and 4 show the strapping unit 70 with an article group 12 arranged therein, which in the embodiment shown comprises a total of six articles 10, in particular six bottles 11, which are combined in a rectangular arrangement. According to FIG. 3, the articles 10 are partially compressed by the contour pieces 2 when the cage 50 is lowered over and surrounds the article group 12. The strapping band (not shown) is located in a clamping arrangement in the strapping unit 70 of the application head 1.

According to FIG. 4, the compression of the articles 10 is released by an outwardly directed movement of the contour elements 2 as soon as the cage 50 together with the strapping band held therein is positioned at an intended height on the article group 12. In addition, the fixation of the strapping band within the strapping unit 70 is released by a movement of the clamping elements 3 directed inward at least for a short time.

If the suction elements 5 are active suction elements 5 under negative pressure, the negative pressure applied to the suction elements 5 is released simultaneously with the inwardly directed movement of the clamping elements 3, whereby the strapping band held there can be separated.

In FIGS. 3 to 5, the change in the opening width W is also shown. FIG. 3 shows the strapping unit 70 in an operating mode BM with a smaller opening width W of the cage 50. In this operating mode BM, the articles 10 are strapped with the strapping band (not shown) arranged in the strapping unit 70. In the operating mode BM, the application head has a first opening width W1 that is at least in regions at least slightly smaller than a width of the article group 12, so that the group 12 is at least slightly compressed.

In contrast, FIG. 4 shows the strapping unit 70 in a release mode FM to which the strapping unit 70 is transferred after the strapping process is completed in order to release the strapped articles 10. In release mode FM, the opening manner of the cage 50 is accordingly increased compared to the operating mode BM (strapping mode). In this release mode FM, the application head has a second opening width W2 that is larger than a width of the article group 12, so that the group 12 is released.

In order to transfer the strapping unit 70 from operating mode BM to release mode FM, contour pieces 2 arranged opposite one another are moved away from one another and thus distanced from the group 12 on both sides. In the present case, the contour pieces 2 arranged on the left are moved to the left and the contour pieces 2 arranged on the right are moved to the right, whereby the opening width W is increased.

In particular, the contour pieces 2 arranged on the left and the clamping element 3 arranged therebetween are associated with a first frame element 55, which can be moved by hydraulic or pneumatic adjusting device 57. Furthermore, the contour pieces 2 arranged on the left and the clamping element 3 arranged therebetween are associated with a second frame element 56, which can be moved by hydraulic or pneumatic adjusting device 58.

Alternatively, as shown in FIG. 5, the contour pieces 2 could be moved away from the center point M in order to increase the opening width W.

Figure 11:
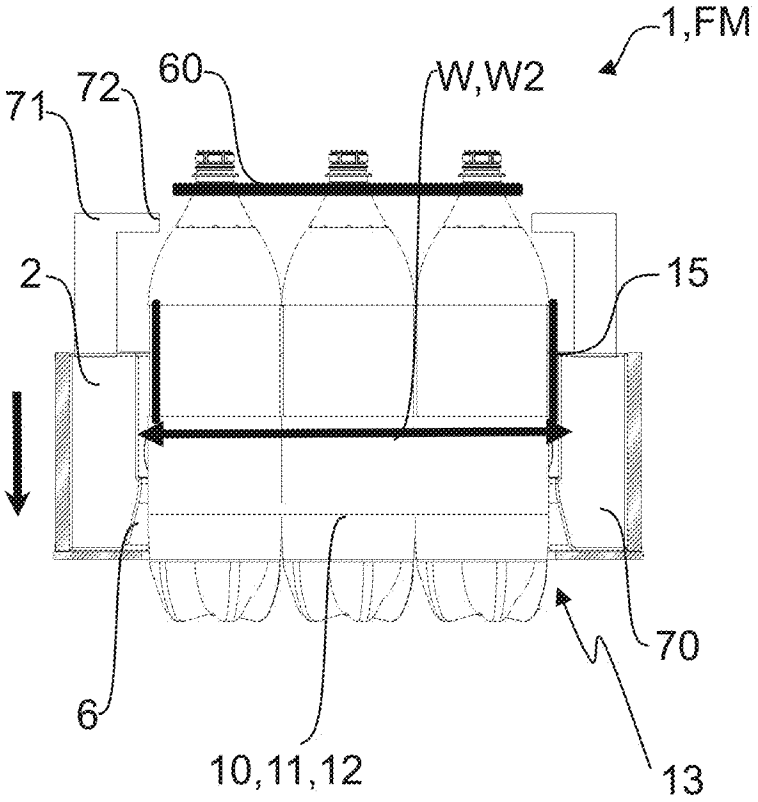
Figure 10:
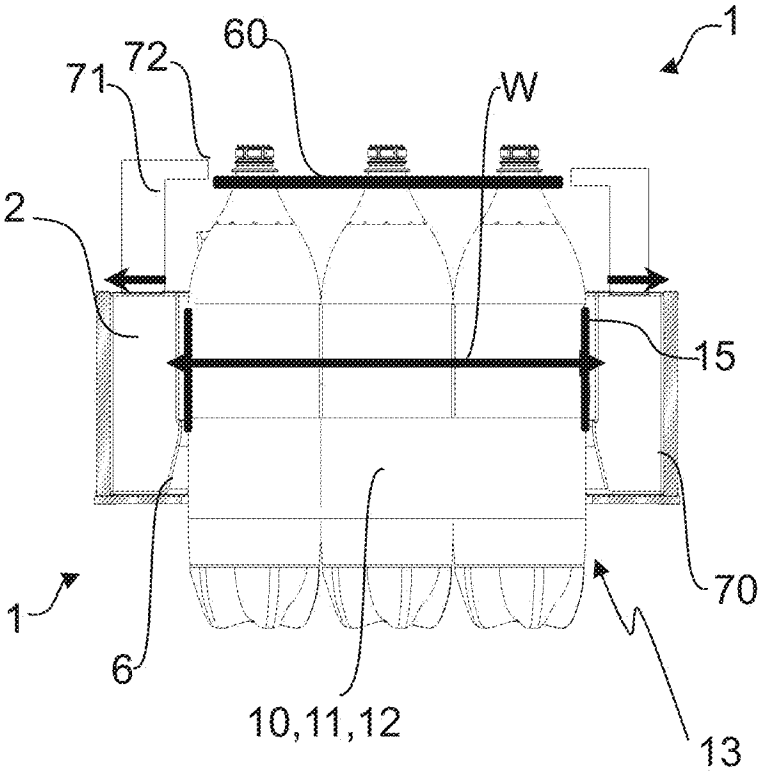

The schematic side views of FIGS. 6 to 12 show the different steps of a method for producing packaging units 13, wherein the step shown in FIG. 11 is an optional step that can optionally also be omitted. FIGS. 6 to 12 each show a sectional view through an application head 1 with articles 10 arranged therein so that the different phases of forming the packaging units from the mechanically interconnected article groups 12 can be illustrated.

The application head 1 comprises in particular a strapping unit 70 already shown in FIGS. 1 to 5 and an application unit 71 arranged above the strapping unit 70 and coupled thereto. This application unit 71 is provided and designed to additionally apply a packaging blank 60 from above to an upper region of the articles 10, in particular to an upper lid or closure region of the articles 10, in temporal connection with the strapping of an article group 12 with a strapping band 15.

The packaging blank 60, which is additionally mechanically connects the articles 10 and holds the article group 12 together in addition to the strapping band 15, is substantially flat, which means in particular that the packaging blank 60 has a small thickness compared to its length and width.

The packaging blanks 60 can in each instance preferably consist of a paper or cardboard material, a plastics material, a cardboard/plastics composite material or the like.

Each of the packaging blanks 60 has passage openings for the articles 10 combined over the packaging blank 60, which passage openings correspond to the longitudinal central axes L of the articles 10 to be combined.

The packaging blank 60 is in each instance attached to the articles 10 in such a way that the articles 10 partially pass through the passage openings of the packaging blank 60 and are thus held together by the packaging blank 60. In particular, the packaging blank 60 is interlocked with the articles 10 in this way.

For this purpose, the passage openings of the packaging blank 60 can each have suitable fixing apparatuses that can be formed, for example, by fixing tabs. For example, fixing tabs are formed by notches or the like extending radially inward from the passage openings.

The packaging blank 60 is pushed onto the articles 10 from above in a direction that is approximately perpendicular to the longitudinal central axes of the articles 10, so that the articles 10 at least partially pass through the passage openings of the packaging blank 60 and, after the packaging blank 60 has been fastened, are located at least in regions above and at least in regions below the packaging blank 60. If the articles 10 are bottles 11 or cans, then the closure region is preferably arranged above the packaging blank 60, while the body filled with a fluid is arranged below the packaging blank 60.

Particularly preferably, the packaging blank 60 is in each instance secured to articles 10 in such a way that the articles 10 are each held in a clamping manner within a passage opening of the packaging blank 60 in the region of an upper taper. In particular, bottles 11 are held in a clamping manner below a so-called neck ring and cans are held in a clamping manner below a flanged edge forming the can edge, whereby an effective interlocking between the packaging blank 60 and the articles 10 is given in each instance.

After the packaging blank 60 has been arranged on and fastened to the articles 10, the packaging blank is preferably in engagement with the articles 10 in such a way that the packaging blank 60 is secured to the articles 10 in a substantially stationary manner and the articles 10 can no longer make any significant relative movements or changes in position relative to one another and relative to the packaging blank 60. As a result, the packaging blank can only be removed from the articles 10 again by applying increased force with a force component directed downwardly or upwardly, wherein the packaging blank 60 is generally at least partially destroyed. However, the packaging blank 60 is generally only removed from the articles 10 by the end customer, immediately before the liquid contained in the articles 10 is consumed, i.e., in particular before the bottle contents are consumed.

In the context of the method, at least two grouped articles 10 are provided as an article group 12 and are positioned in a movement and/or handling area of an application head 1. In the example shown, six articles 10 are provided in two rows of three, wherein only one row of three is visible due to the sectional view.

In particular, when the application unit 71 and the strapping unit 70 of the application head 1 are used as intended, it is provided that strapping and an upper packaging blank are applied to the articles 10 of the article group 12 substantially simultaneously.

In temporal connection with the provision of the articles 10 in the movement and/or handling area of the application head 1, either simultaneously or upstream, or immediately after the provision of the article group 12, at least one pre-assembled closed strapping band 15 is inserted into the application head 1 and fixed in a defined position (see FIG. 6) in the application head 1 by the clamping elements 3. In particular, the at least one pre-assembled closed strapping band 15 is inserted into the strapping unit 70 of the application head 1 and is fixed in a defined position (FIG. 6) in the strapping unit 70 of the application head 1 by the clamping elements 3.

The ring shape of the typically closed strapping band 15, which is pre-assembled in the required length, is thus predetermined and maintained by the contour pieces 2 and the guide pieces 4 (see FIGS. 1 to 5). In order to keep the strapping band 15 in position or in the required ring shape during the application process, the above-described clamping elements 3 and suction elements 5 or adhesion grippers, vacuum grippers or the like are provided, which ensure that the strapping band 15 is pulled onto the article group 12. These can either be distributed along the circumferential contoured guide 51 or specifically at distinctive points, for example in the region of the corner radii or the like. For example, a contoured clamp with a vertical flash face or an undercut, as described below in connection with FIGS. 13 to 15, can be made possible along the entire contoured guide 51 of the cage 50 of the strapping unit 70 of the application head 1 or also in parts.

In addition, the application head 1 is equipped with a packaging blank 60 of the size that is required in each instance. In particular, the packaging blank 60 is inserted into the application head 1 and held in a defined position by a suitable holding device 72. In particular, the holding device 72 in each instance fixing the packaging blank 60 in place is associated with the application unit 71.

Subsequently, the application head 1 equipped with the at least one strapping band 15 and a packaging blank 60 is lowered by a feeding movement over the articles 10, wherein the cage 50 of the strapping unit 70 of the application head 1 contacts and at least slightly compresses the grouped articles 10 on their lateral sides of the articles 10.

When reference is made in the present context to a lowering of the application head 1 over the grouped articles 10, it can thus also mean lifting the grouped articles 10 from below into the application head 1 or, in general, a feeding movement of the articles 10 and of the application head 1 with a direction of movement parallel to the longitudinal central axes of the articles 10. It should thus be clarified that these variants can also be understood from the formulation the lowering.

Figure 7:
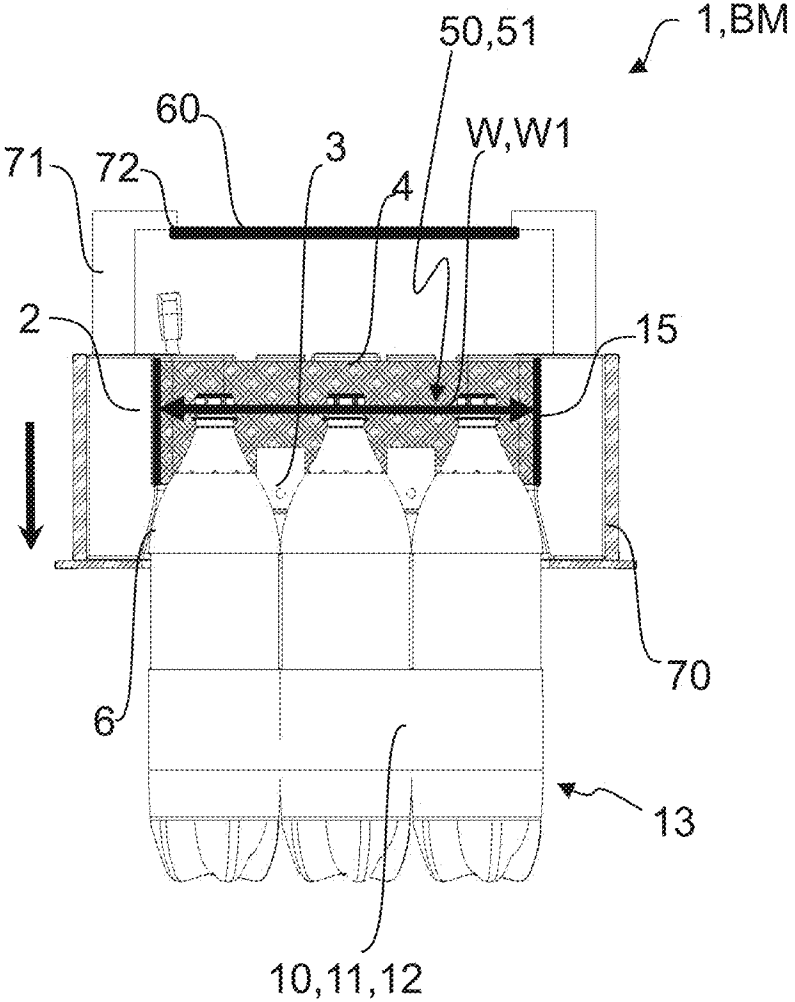
FIGS. 6 to 12 show the different steps of a method for producing packaging units.
Figure 6:
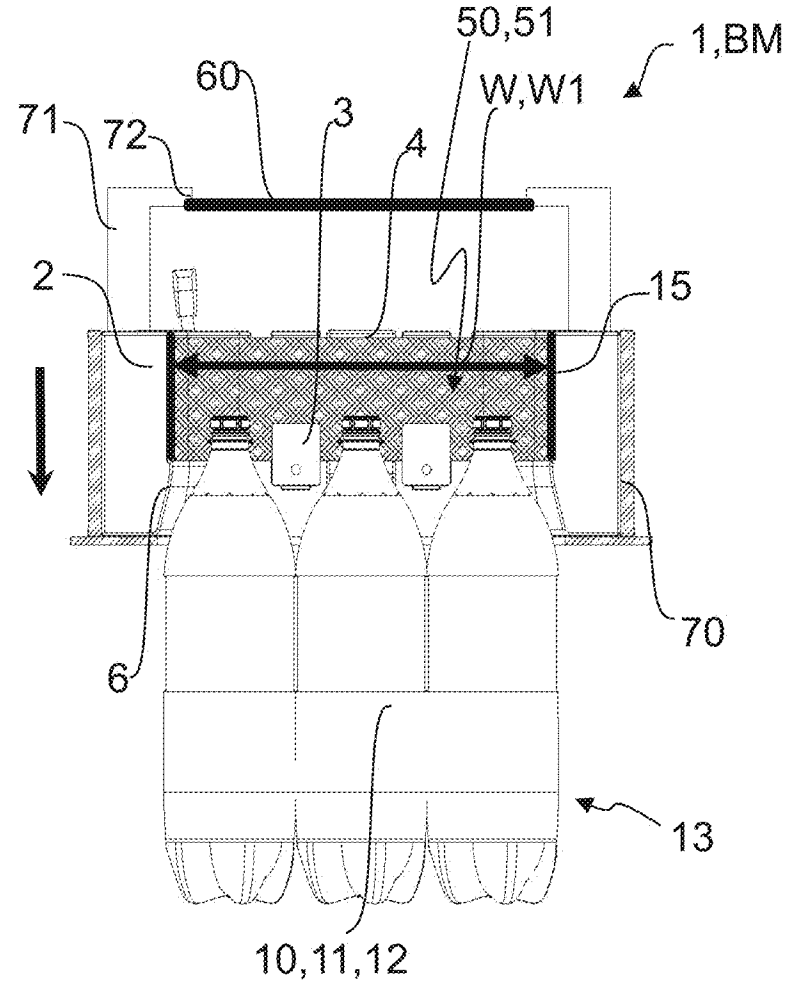
Figure 9:
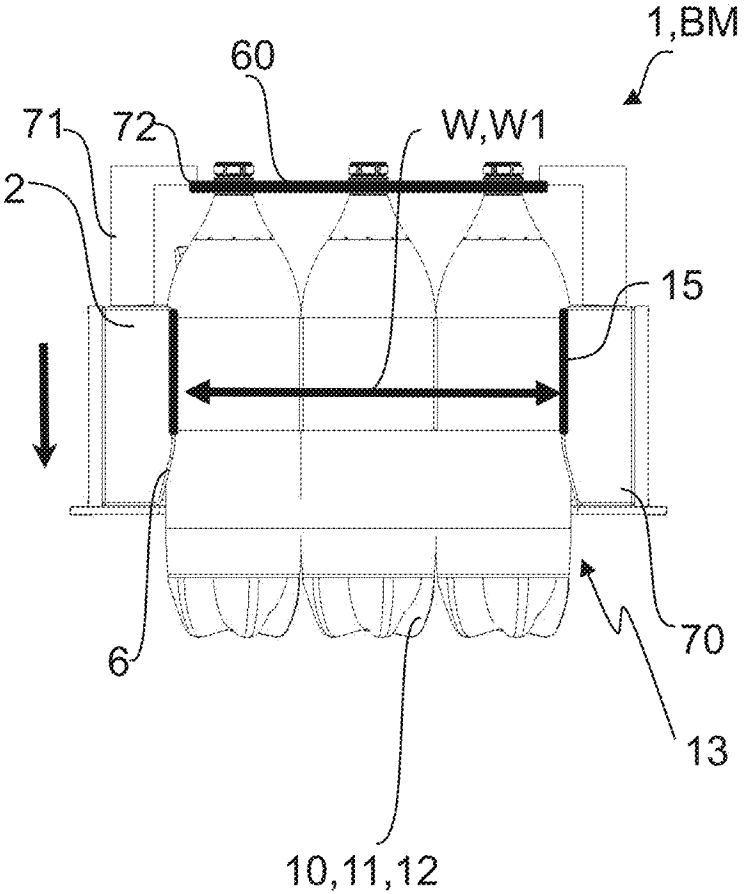
Figure 8:
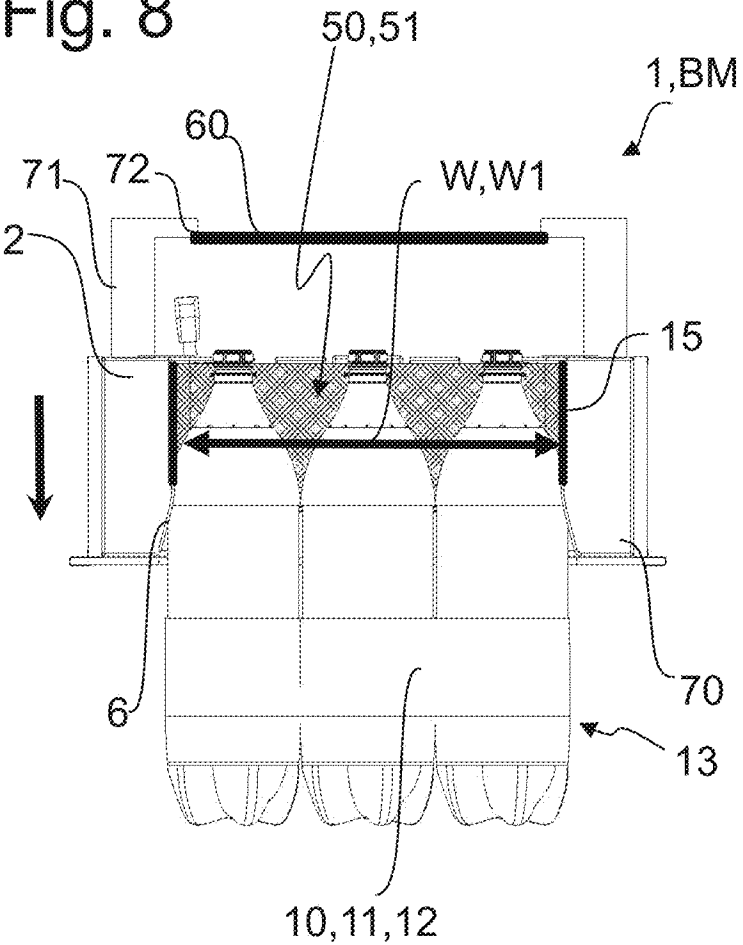

The defined lowering of the application head 1 according to FIGS. 7 to 9 (or generally by the feed movement of the application head 1 toward the grouped articles 10) positions the strapping band 15 at an intended position of the articles 10. With increasing depth of the stroke, the compression applied to the lateral surfaces of the articles 10 increases until the desired compression is achieved. The stroke required for this purpose is defined and maintained by the design of the compression slope 6 on the contour pieces 2 of the strapping unit 70 of the application head 1. As the downward movement progresses, the inserted strapping band 15 is now pushed over the compressed article group 12.

In addition, during this time, the packaging blank 60 is placed onto the upper sides of the articles 10. A further downwardly directed movement of the application head 1 causes the packaging blank 60 to be secured to the articles 10.

Depending on the desired position of the packaging blank 60 and the strapping band 15, which is determined in particular by the size, contour and geometry of the articles 10 to be packaged, the strapping band 15 is generally first applied to the article group 12 in the desired position and the packaging blank 60 is pressed onto the article group 12 from above with a further progressive downward movement. However, it is also conceivable to reverse the order and to apply both packaging elements, i.e., the packaging blank 60 and the strapping band 15, in a temporally synchronous manner.

When the desired position of the strapping band 15 and the package blank 60 on the article grouping 12 is reached, the downward movement is stopped (FIG. 9).

The at least one strapping band 15 is now released and separated from its fixed position in the strapping unit 70 of the application head 1. In particular, the clamp between the strapping band 15 and the clamping pieces 3 and/or the suction connection between the strapping band 15 and the suction elements (not visible) is released to remove the fixing of the strapping band 15.

Subsequently or substantially simultaneously, the opening width W of the cage 50 of the application head 1 is increased in order to eliminate the compression between the cage 50 and the article group 12 combined with the packaging blank 60. After the separation of the application head 1, the strapped article group 12 that is combined with packaging blank 60 forms a packaging unit 13.

In particular, after the packaging units 13 have been produced, the cage 50 is opened by opening movements of individual segments of the cage 50 directed perpendicularly away from the lateral surface of the articles 10. For example, the contour pieces 2 are moved away from one another in the opposite direction of movement, as shown by the horizontally oriented arrows in FIG. 10. In this case, at least the strapping unit 70 of the application head 1 is transferred to the release mode FM with a second opening width W2.

In particular, the contour elements 2 are moved away from the finished packaging units 13 by a movement perpendicular to the article longitudinal axis L, wherein a rotational movement and a combination of a rotational and translational movement are also conceivable. A distance between the compression surfaces formed by the compression slope 6 and the articles 10 is thereby produced, whereby the articles 10 are returned and a tension is produced with respect to the strapping band 15, as a result of which the necessary bundle stability is produced.

In particular, it is provided that the compression of the cage 50 is released as soon as the strapping band 15 has been stripped and is attached to the article group 12 at its intended target position and is positioned there with the intended pre-tension.

Depending on the arrangement of the fixing elements, in particular of the clamping elements 3, it may initially also be necessary, if for example the clamping elements 3 hold the strapping band 15 at the lower edge, to continue the downwardly directed movement of the application head 1 after the fixing has been released until the strapping band 15 is arranged outside the fixing region and only then, under certain circumstances, to release the compression (FIG. 11). In addition, to release the compression, it may also be necessary to move the clamping elements 3 away from the packaging unit 13 in order to avoid a collision when the application head 1 is lifted with that of the packaging unit 13.

Simultaneously with the opening of the cage 50, it can preferably be provided that the at least one holding device 72 releases the packaging blank 60 applied to the articles 10 by the application unit 71.

Figure 12:
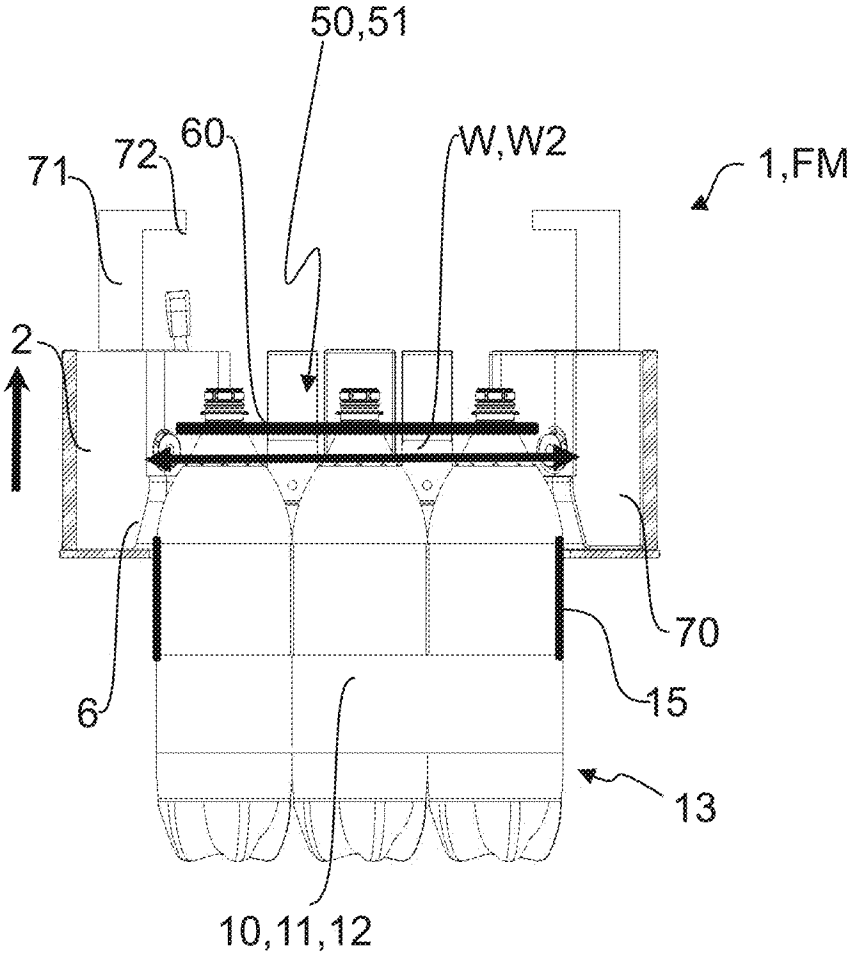

The application head 1 in release mode FM is removed from the packaging unit 13 counter to the application direction and is moved back to an initial position for reloading with a strapping band 15 and with a packaging blank 60 (FIG. 12). As a result of the lifting, the packaging unit 13 equipped with a strapping band 15 and a packaging blank 60 is released and can now be supplied for further handling, for example palletizing or the like (not shown here).

After the packaging unit 13 has been released, the application head 1 is transferred back to the operating mode BM by a corresponding feeding movement of the contour pieces 2 of the strapping unit.

Alternatively, it would also be conceivable to release the compression by the strapping unit 70 of the application head 1 before application of the package blank 60 by a further downwardly directed movement of the application head 1 if, for example, due to the present container geometry, the end position of the strapping band is reached before the end position of the packaging blank 60 on the article group 12. In this case, the release of the package blank 60 must not be coupled to the adjustment of the opening width W of the cage 50 of the strapping unit 70.

Preferably, the strapping band 15 is inserted into the application head 1 in such a way that the part of the strapping band 15 with the connection point, in particular the adhesive point or weld point or the like, is placed on a side of the strapping band arranged perpendicular to the subsequent transport direction of the packaging unit 13. As a result, the connection point at which regions of the strapping band 15 can optionally overlap one another is prevented from hanging on guide strips of subsequent handling modules or the like, and the strapping band 15 is prevented from tearing accordingly.

The combination described here of two packaging steps previously carried out separately by a combined application process results in significantly reduced process times. Since only a single application device is required instead of two separate packaging modules, the footprint of the packaging machine used in each instance is reduced. In addition, the application of the packaging blank 60 and strapping band 15 is better coordinated because only one synchronization of the application head 1 carrying out both packaging steps to the article group 12 is necessary, and not a multiple synchronization of successive, but temporally and spatially separated application steps.

Figure 14:
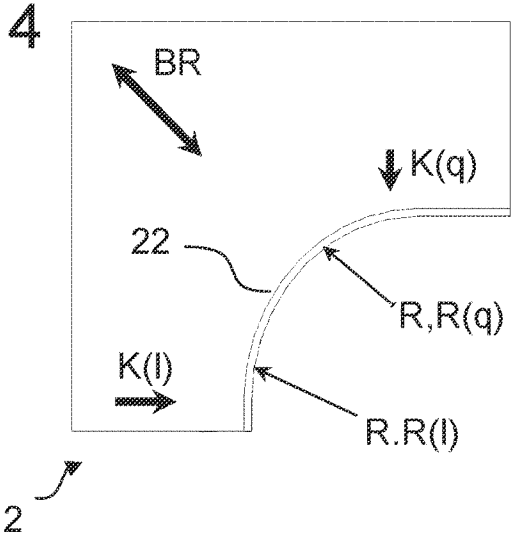
FIGS. 13 to 15 show different views of a contour piece.
Figure 13:
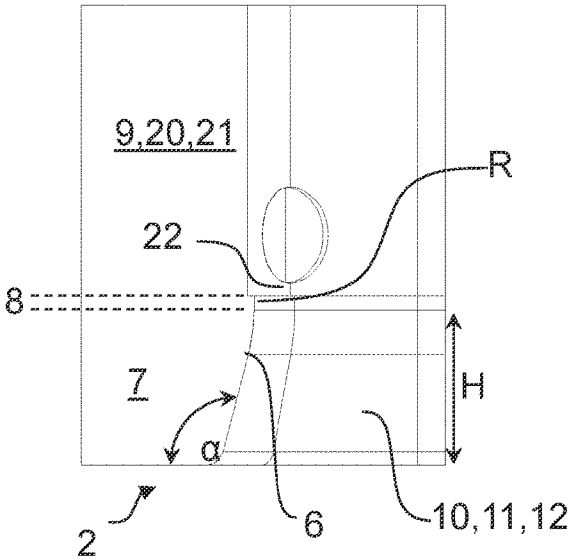
Figure 15:
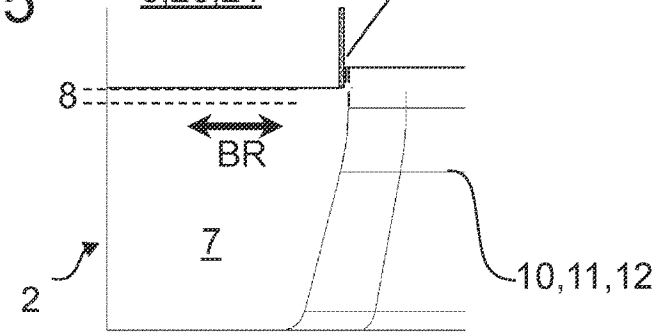

The schematic representations of FIGS. 13 to 15 show different views of a contour piece 2 of the strapping unit 70 of an application head 1, as has already been shown and described above. In particular, FIGS. 13 and 15 are each a side view and FIG. 14 is a plan view of the contour piece 2.

The contour pieces 2 are shaped and designed such that, in the installed state, they have an insertion region 7, a compression region 8 and a region 9 set back behind the compression region 8 in the direction of the article longitudinal axis L (see FIGS. 2 and 12). The set-back region 9 is designed, in particular, as a vertical flash face 20 or undercut 21, which is intended to allow the strapping band to be guided to its intended position without the contour pieces 2 being stripped prematurely.

The strapping band 15 is placed in the set-back region 9 of the contour piece 2 (FIG. 15). This is necessary in order to prevent the strapping band 15 from being placed on the contour of the articles 10, which could result in premature hanging of the strapping band 15 during the downward movement of the application head (cf. FIGS. 6 to 9). In this case, the strapping band 15 could be overstretched or damaged, or correct application to the article group 12 could be prevented.

The circumference of the in particular pre-assembled closed strapping band 15 is selected such that it is protected by the set-back region 9 or undercut 21, but is not larger than necessary. When the compression is released, a strapping band 15 would not achieve sufficient tension between the strapping band 15 and the article group 12, which is to be avoided. In particular, the friction between the articles 10 would be lost, which would result in reduced bundle stability. The useful length of the strapping band is thus determined by the overall circumference of the article grouping 12 and the deformability of the articles 10 in the grouping, which can ensure the strapping tension thereof after the strapping band is applied.

The compression applied to the individual articles 10 of the article group 12 is defined by the geometry of the contour piece 2 and the inner opening width of the cage 50 with the contour pieces 2 arranged therein. The amount of compression is defined by the difference between the compression radius R for the corresponding compression axis and the uncompressed article radius. The contour piece 2 can in particular have a radius R(l) for the compression K(l) longitudinally to the article group 12 and/or a radius R(q) for the compression K(q) transversely to the article group 12.

The compression is always applied in at least one direction to the respectively contacted articles 10 of the article group 12. In general, the compression K(l) is applied longitudinally to the article group 12. Alternatively, however, compression K(q) can also be applied transversely to the article group 12. A combination in both compression axes is also possible, i.e., a compression K(l) longitudinal to the article group 12 and a compression K(q) transverse to the article group 12. In this case, the contour piece 2 according to FIG. 5 is moved in the direction of movement BR shown by the movement arrow.

In the case of compression in one axis, the inner contour 22 of the contour piece 2 is designed so that, starting from the compression radius R, the radius decreases to the uncompressed radius, so that the articles 10 are guided only in this axis. In the case of biaxial compression, the corresponding compression radii R(l) and R(q) can be selected to be different. In addition to the geometry of the contour pieces 2, an additional adjustment of the final compression can be carried out via a further infeed of the contour pieces 2 to the article group 12.

The selected shape and inclination of the insertion slope, referred to as compression slope 6, can influence how quickly the desired compression of the article group 12 is achieved. In particular, the selected shape also determines how much downward stroke of the application head 1 or what relative stroke is required in the direction of the article longitudinal axis relative to the article group 12. In addition, this also influences how much force must be applied for the compression, because, depending on the steepness of the compression slope 6, more or less friction is generated when the strapping unit 70 of the application head 1 is pushed onto the article group 12. Thus, by the height H of the insertion region 7 and the angle $\alpha$ of the compression slope 6, the geometry suitable for the corresponding group 12 can thus be designed, in particular depending on the desired compression, the article geometry, and the corresponding friction pairings.

Preferably, the application head 1 is designed such that different articles 10 can also be processed with the same or similar article geometry, even if the opening width of the cage 50 differs from the base surface of the corresponding group 12. If the application head 1 is to be used for different basic dimensions of different article groups 12, the desired or technically required compression must be set by corresponding positioning of the contour pieces 2 in the longitudinal and transverse directions. In this way, defined similar diameter ranges can be covered in each instance.

The cage 50 provided by the strapping unit 70 of the application head 1 can also be enlarged or reduced and thus adapted to different pack sizes by optionally inserting further guiding and holding elements 4 or by removing guiding and holding elements 4.

The articles 10 are pushed between the strapping band 15 by the contour pieces 2 of the strapping unit 70 of the application head 1, wherein, due to the compression of the articles 10, there is initially a certain distance between the strapping band 15 held in the strapping unit 70 of the application head 1 and the article group 12. Thus, there is a spatial separation between the strapping band 15 and the articles 10, which is eliminated by the release of the compression.

Figure 17:
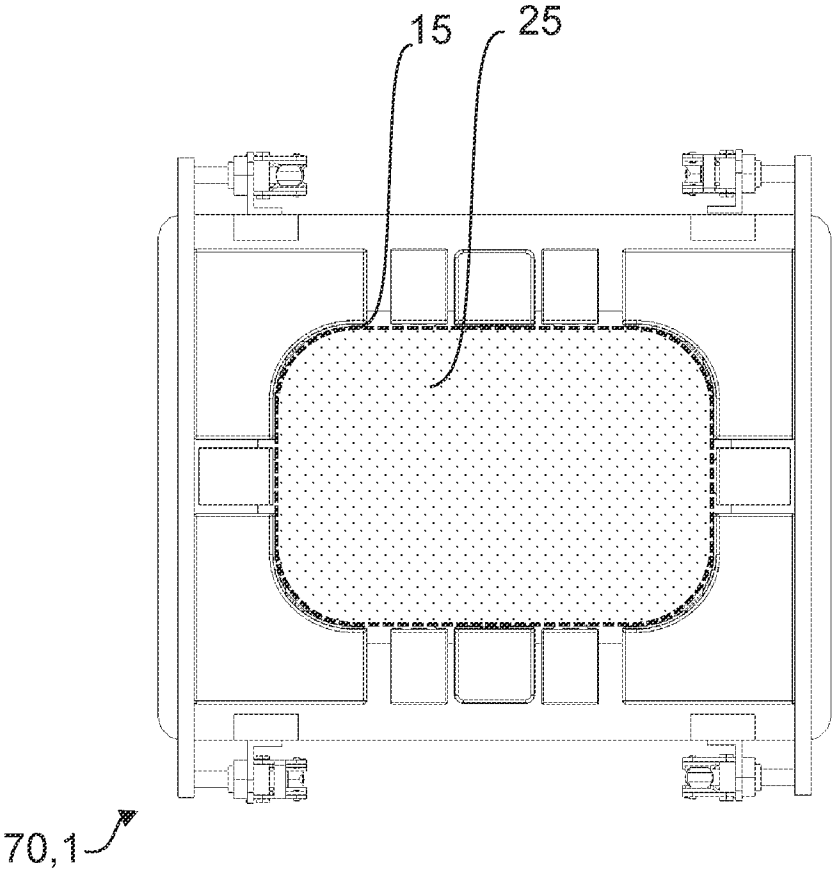
FIGS. 16 to 21 show the transfer process of the strapping band to the strapping unit of the application head.
Figure 16:
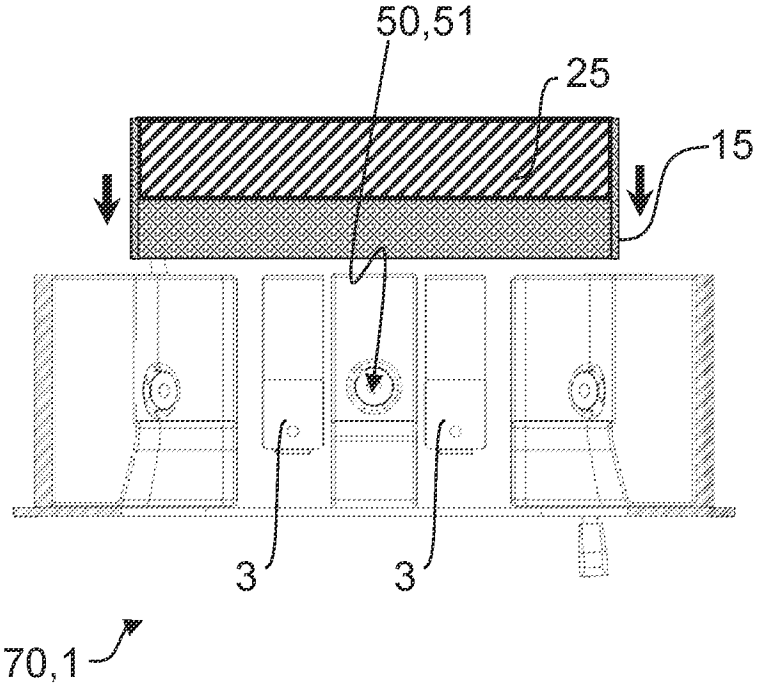
Figure 19:
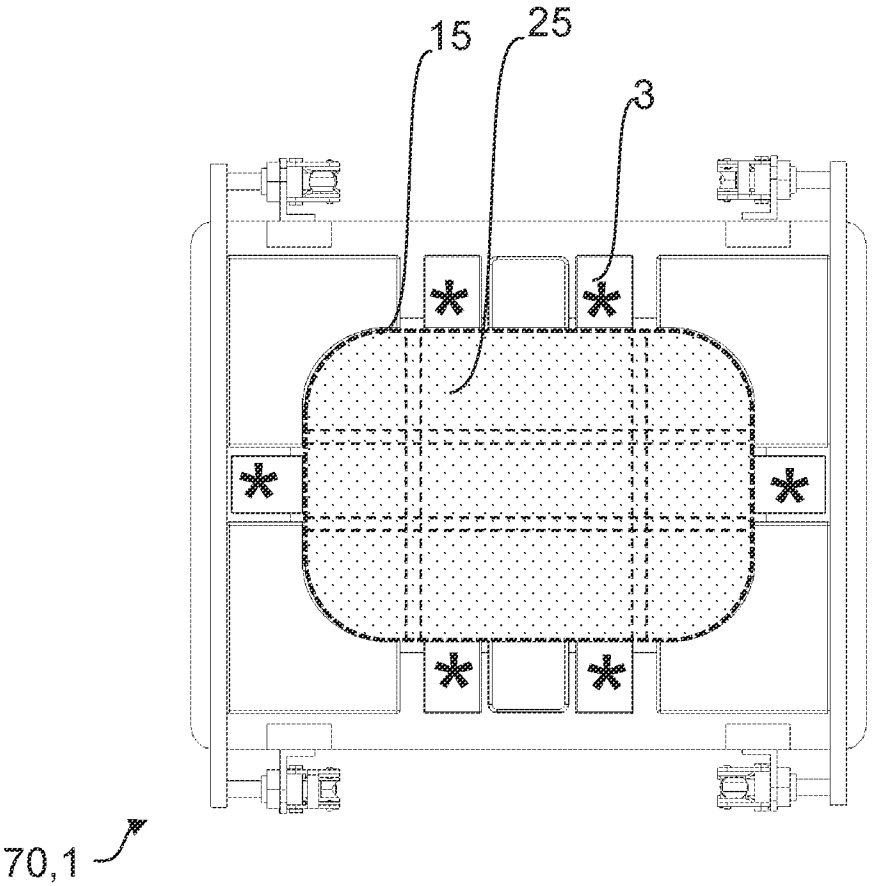
Figure 18:
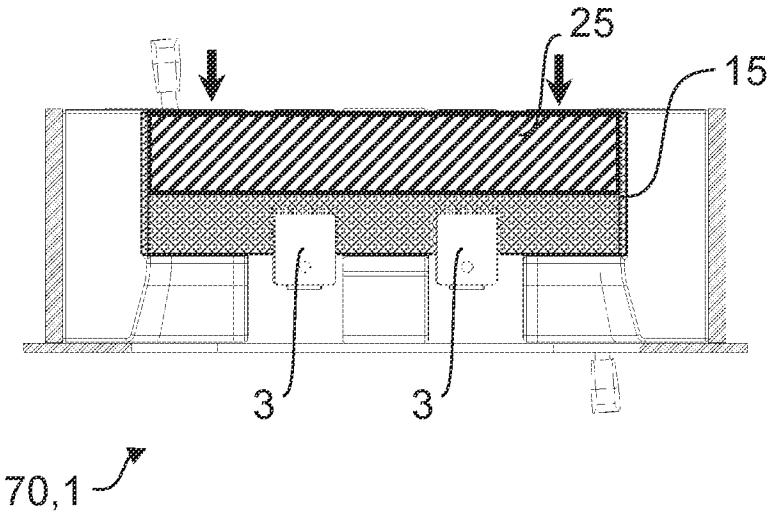
Figure 21:
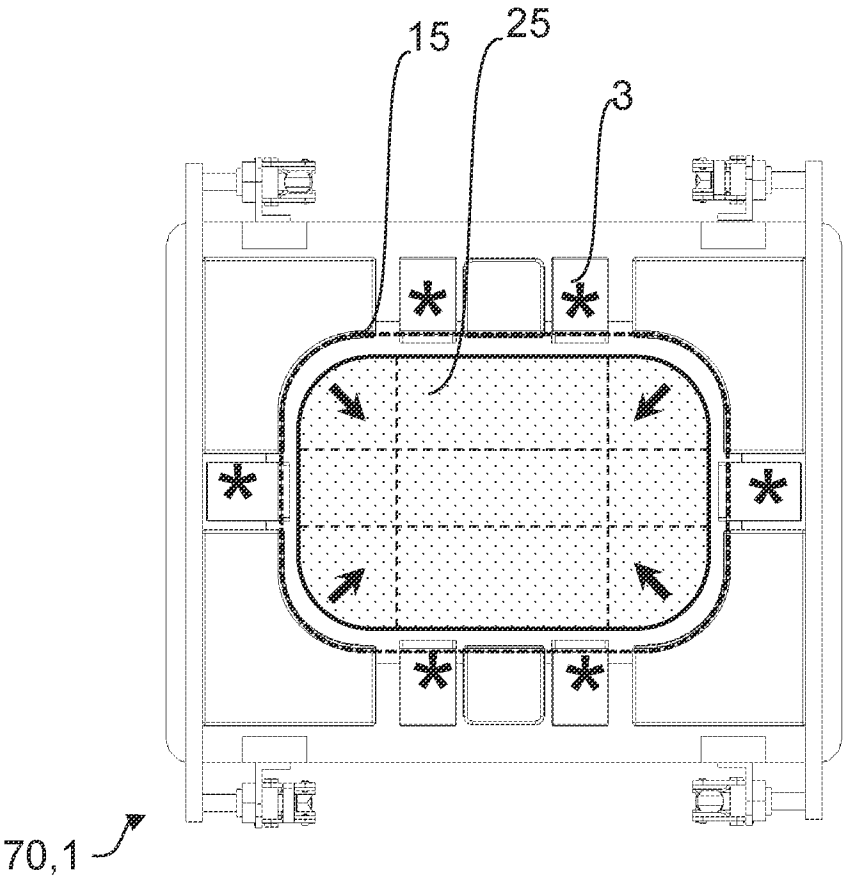
Figure 20:
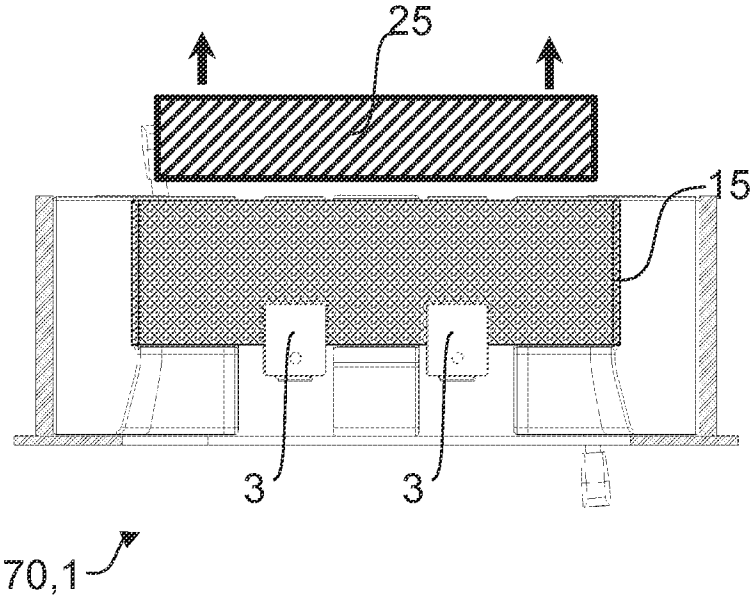

FIGS. 16 to 21 show the transfer process of the pre-assembled strapping band 15 to the strapping unit 70 of the application head 1 so that it can be made ready to apply the strapping to a prepared article group 12. In this case, FIGS. 16, 18 and 20 are each a side view of the strapping unit 70, while FIGS. 17, 19 and 21 are corresponding views from above.

A transfer element 25, which has exactly or approximately the contour of the pre-assembled strapping band 15 to be inserted, is used to insert the strapping band into the application head 1. The transfer element 25 takes the ring-shaped strapping band 15 from a corresponding preparation module (not shown). The transfer element 25 with the strapping band 15 is placed over the strapping unit 70 of the application head 1 (FIGS. 16 and 17).

Preferably, the strapping band 15 is fixed to the transfer element 25 by suitable suction elements or clamping elements or other suitable fixing apparatuses, wherein the lower edge of the strapping band 15 preferably protrudes at the bottom beyond the transfer element 25, so that the lower region of the strapping band 15 can be inserted into the clamping elements 3 of the strapping unit 70 of the application head 1. If the strapping band 15 is held in the strapping unit 70 of the application head 1 by suction elements 5 only, a lower protrusion of the strapping band 15 beyond the transfer element 25 can be dispensed with. In addition, in this case it would also be possible for strapping band 15 to be inserted into the transfer element 25 from below.

By a downward movement of the transfer element 25 and/or an upward movement of the application head 1, the strapping band 15 is now placed in a desired arrangement within the strapping unit 70 of the application head 1 (FIGS. 18 and 19). By closing the clamping elements 3, as indicated and illustrated in FIGS. 19 and 21 by an asterisk, and/or by activating the suction elements 5 of the strapping unit 70 of the application head 1 and opening and/or deactivating corresponding fixing apparatuses of the transfer element 25, the strapping band 15 is transferred from the transfer element 25 to the strapping unit 70 of the application head 1.

The transfer element 25 is then removed by an upwardly directed movement of the transfer element or a downwardly directed movement of the application head 1 (FIGS. 20 and 21) and can subsequently be moved into a starting position for reloading with a further strapping band 15. In this case, it may be necessary to reduce the circumference of the transfer element 25 in order to allow a reliable removal of the strapping band from the application head 1. For this purpose, the transfer element 25 can be segmented, wherein the segments can be moved toward a center of the transfer element 25, thereby reducing the circumference of the transfer element 25 takes place.

It is particularly advantageous in the method described above that it is not necessary to adhere or otherwise fix the strapping band 15 to the article group 12. By using the correspondingly designed application head 1, the complexity of the strapping process can be reduced.

To load the strapping unit 70 with the strapping band 15, it may be necessary for at least parts of the application unit 71 (not shown in FIGS. 16 to 21) of the application head (see FIGS. 6 to 12) to be folded outward for a short time or the like so that the transfer element 25 with the strapping band 15 has access to the strapping unit 70.

Figure 22:
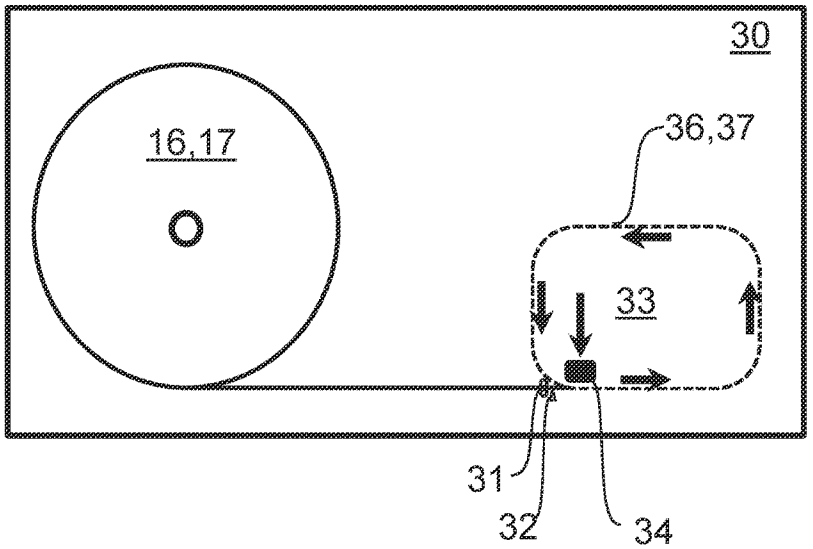
FIGS. 22 and 23 show the pre-production of the strapping band.
Figure 23:
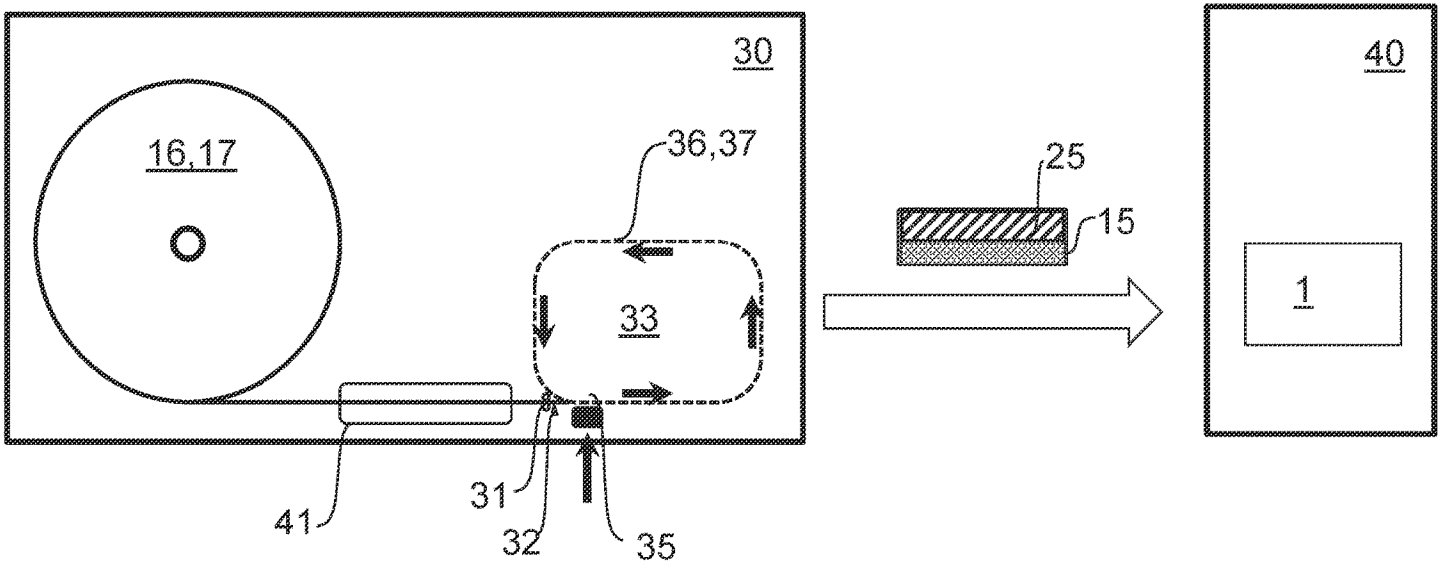

The schematic views of FIGS. 22 and 23 show the pre-production of the strapping band 15 in a preparation module 30. In this case, an endless strapping material 16 is provided, for example, as a reeled material 17 in a required width. This is fed in a corresponding preparation module 30 via a feed apparatus 31 to a separating apparatus 32.

The feed apparatus 31 can consist, for example, of two oppositely rotating rubberized rollers that unwind the reeled material 17 accordingly. The separating apparatus 32 consists, for example, of a downstream knife or other suitable cutting unit.

The separating apparatus 32 cuts strapping material 16 to a defined length, and the free end regions of the strapping material 16 cut to length are connected to one another to form the ring-shaped, pre-assembled strapping band 15. In particular, the free end regions are thereby arranged partially overlapping and are connected to one another by gluing or a welding process or the like.

In the embodiment shown, a gluing unit 33 is shown, comprising a glue application apparatus 34 and a contact pressure apparatus 35 to form an adhesive connection.

A frame 36 is associated with the gluing unit 33, which frame maps the desired circumference of the strapping band 15 to be formed in a recess and a circulating conveying unit 37 associated with the frame 36. The frame 36 can be segmented and, by adjusting individual frame segments, the frame circumference and thus the circumference of the strapping band 15 to be formed can be adjusted.

This makes it possible to react to any circumferential variation of the article groups or to perform a format change with the same strapping material 16.

To transport the strapping material 16 along an inner or an outer contour of the frame 36, one or more vacuum belts and/or mechanical conveying elements, for example circulating clamping elements, rubberized belts, conveyor belts, or the like can be used.

The strapping material 16 is conveyed once around the entire inner or outer contour of the frame 36 by the conveying unit 37 until an overlap is formed in the region of the gluing unit 33.

The cut-to-length strip of strapping material 16 is provided with glue at the starting region and/or at the end region by the glue application apparatus 34, the starting region and the end region are arranged overlapping one another and then pressed out by a contact pressure die of the contact pressure apparatus 35, thereby creating a load-bearing connection.

The correspondingly closed strapping band 15 can now be picked up by a transfer element 25 in the manner described above and supplied to the application head 1 of an application device 40 for strapping an article group. The application device 40 has a movement and/or handling area for the application head 1 for cooperation with at least two articles grouped within the movement and/or handling area.

With the arrangement of such a preparation module 30, changes in the article groups can be responded to in an inline manner. If the format changes, only the material needs to be changed if a different width of the strapping material 16 is necessary. The costs for the preparation module 30 are quickly recouped because strapping material 16 provided on rolls is much less expensive than specially pre-assembled closed strapping bands 15.

Figure 24:
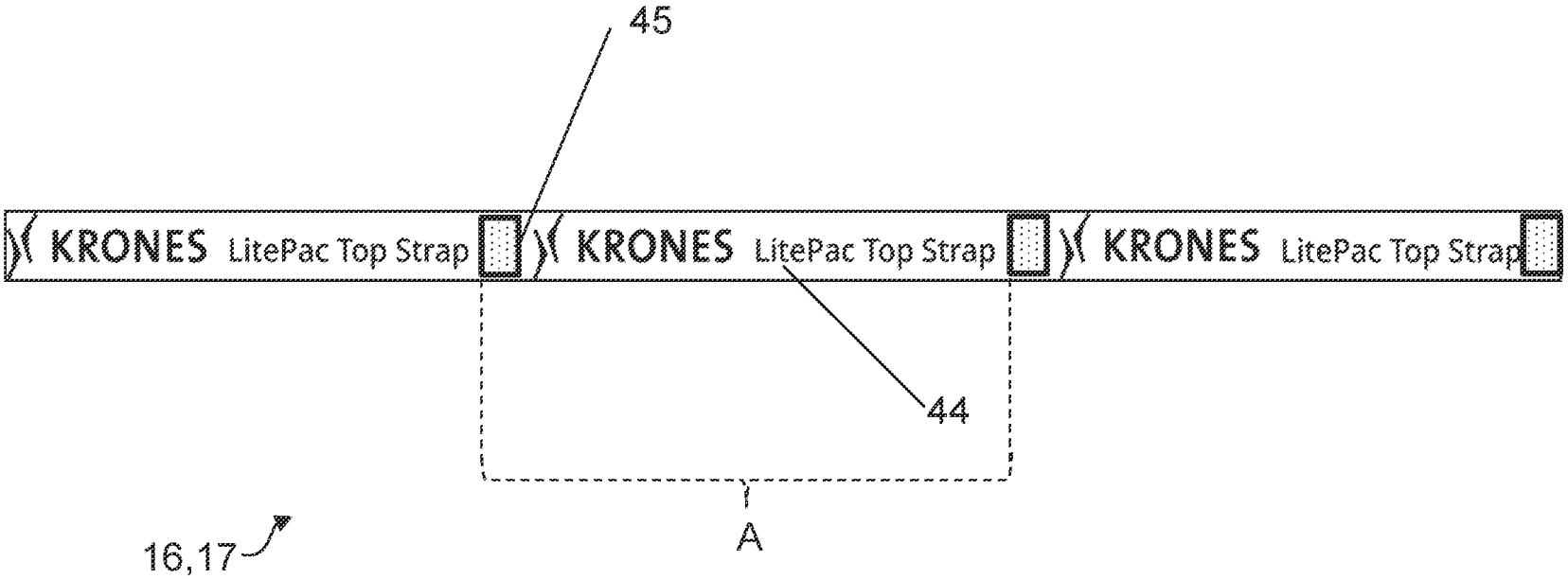
FIG. 24 shows the inline printing during the formation of a strapping band.

FIG. 24 shows so-called inline printing during the formation of a strapping band 15, which is provided as an endless reeled material 17 according to FIGS. 22 and 23. In particular, it is provided that a type of scattered print 44 is applied as a basic print design on the reeled material 17. This is a printed image that repeats at a defined interval A. Ideally, the interval A is designed in such a way that it results in at least a complete repetition of the pattern per length of a strapping band 15 for all formats to be processed, in particular bundle circumferences, in the corresponding width of the strapping material 16.

If, in addition, a bundle-specific print is to be present on the strapping band 15 to be formed, an empty field 45 is designed as a component of the scattered print 44. In this empty field 45, the desired printing can take place in an inline manner, for example in the form of a barcode, format information, best-before date, etc. For this purpose, in particular a printing unit 41 (FIG. 23) arranged in the preparation module 30 can be provided, so that the desired printing takes place as part of the formation of the closed strapping band 15. Alternatively, a corresponding printing unit can also be associated with the application device 40, wherein the printing can take place before the applied strapping band 15 is applied to the grouped articles or after the packaging unit has been formed.

The inline print can be positioned within the empty fields 45 by evaluating the unrolled length and back-calculating of the position of the empty field 45 to be printed. Alternatively, sensor detection of the empty field or other markings present on the strapping material 16 can be provided. For example, the detection of a special geometric marking that is a component of the scattered print 44 is conceivable.

The advantage of such inline printing is that it reduces the amount of strapping material 16 required because it can now be used flexibly. This further reduces material costs because the same strapping material 16 can be used for different products.

The embodiments, examples and variants of the preceding paragraphs, the claims or the following description and the figures, including their various views or respective individual features, may be used independently of one another or in any combination. Features described in connection with an embodiment are applicable for all embodiments provided the features are not incompatible.

If in the present context reference is also generally made to schematic representations and views, this in no way means that the figure representations and their description are to be of subordinate importance with regard to the disclosure of the invention. The person skilled in the art is certainly able to derive sufficient information from the schematically and abstractly drawn representations that will make it easier for the person skilled in the art to understand the invention without being confused in any way by the drawn and possibly not exactly true-to-scale proportions of the articles and/or parts of the application device or other drawn elements. The figures enable the person skilled in the art as reader to get a better understanding of the inventive idea, which has been formulated more generally and/or more abstractly in the claims and in the general part of the description, on the basis of the more specifically explained implementations of the method according to the invention and the more specifically explained mode of operation of the device according to the invention.

The invention has been described with reference to a preferred embodiment. However, it is conceivable for a person skilled in the art that modifications or changes can be made to the invention without departing from the scope of protection of the following claims.

LIST OF REFERENCE SIGNS

1 application head
2 contour piece
3 clamping element
4 guide or holding element
5 suction element
6 compression slope
7 insertion region
8 compression region
9 reset region
10 article
11 bottle
12 article group
13 packaging unit
15 strapping band
16 strapping material
17 reeled material
20 vertical flash face
21 undercut
22 inner contour
25 transfer element
30 preparation module
31 feed apparatus
32 separating apparatus
33 gluing unit
34 glue application apparatus
35 contact pressure apparatus
36 frame
37 circumferential conveying unit
40 application device
41 printing unit
44 scattered print
45 empty field
50 cage
51 contoured guide
55 first frame element
56 second frame element
57 adjustment device
58 adjustment device
60 packaging blank
70 strapping unit
71 application unit
72 holding device
$\alpha$ angle
A distance
BM operating mode
BR direction of movement
FM release mode
H height
K(l) compression longitudinally to the article group
K(a) compression transversely to the article group
L article longitudinal axis
M center point
R compression radius
R(l) longitudinal radius for compression R(q) transverse radius for compression
W opening width
W1 opening width in operating mode
W2 opening width in release mode

The invention claimed is:

1. A method for producing packaging units (13), each of which is made of at least two grouped articles (10) that are held together by at least one strapping band (15) and by at least one packaging blank (60), the method comprising:

providing the at least two grouped articles (10), which are positioned in a movement and/or handling area of an application head (1), inserting at least one pre-assembled closed strapping band (15) into the application head (1), in which the strapping band (15) is fixed in a defined position, which application head (1) has a variable opening width (W) of a cage (50) that can surround the grouped articles (10) on a lateral side, inserting a prepared packaging blank (60) into the application head (1) in which the packaging blank (60) is held in a fixed position, feeding the application head (1) equipped with the at least one strapping band (15) and at least one packaging blank (60) to the articles (10) in a feeding movement approximately parallel to a longitudinal central axes (L) of the grouped articles (10), wherein the cage (50) of the application head (1) contacts the grouped articles (10) on their lateral sides and at least slightly compresses them, positioning the strapping band (15) at an intended position of the grouped articles (10) on the grouped articles (10), securing the packaging blank (60) to the grouped articles (10), increasing the opening width (W) of the cage (50) of the application head (1) while simultaneously releasing and separating the at least one strapping band (15) from its fixed position within the application head (1), releasing and separating the at least one packaging blank (60), removing the application head (1) from the strapped article grouping (12) combined by a packaging blank (60).

2. The method of claim 1, further comprising releasing the compression of the cage (50) once the strapping band (15) has been stripped and is attached to the article grouping (12) at its intended target position and is positioned there with the intended pre-tension.

3. The method of claim 2, further comprising releasing the packaging blank (60) once the packaging blank (60) is secured to the articles (10) in a defined position.

4. The method of claim 3, further comprising simultaneously positioning the strapping band (15) at an intended position on the grouped articles (10) and securing the packaging blank (60) to the articles (10).

5. The method of claim 3, further comprising asynchronously positioning the strapping band (15) at an intended position on the grouped articles (10) and securing the packaging blank (60) to the articles (10).

6. The method of claim 1, further comprising producing the strapping band (15) from a strapping material (16) in strip form and positioning it immediately thereafter in the application head (1).

7. The method of claim 6, further comprising applying an individual print to the strapping material (16) or to the strapping band (15) before positioning in the application head (1).

8. An application device (40) for producing packaging units (13), each of which is made of at least two grouped articles (10) that are held together by at least one strapping band (15) and by at least one packaging blank (60), the application device (40) comprises a movement or handling area for an application head (1) for cooperation with at least two grouped articles (10) within the movement or handling area, wherein the application head (1) comprises a cage (50) having a variable opening width and a region for inserting at least one pre-assembled closed strapping band (15), wherein the cage (50) can surround the grouped articles (10) on the lateral side, wherein the application head (1) comprises at least one holding means (72) for a packaging blank (60), wherein the application head (1), together with the at least one strapping band (15) fixed therein and the at least one held packaging blank (60), can be fed to the grouped articles (10) located in the movement area by a feeding movement running approximately parallel to longitudinal central axes (L) of the articles (10), wherein the cage (50) of the application head (1) contacts the grouped articles (10) on their lateral sides and at least slightly compresses them, and wherein the cage (50) of the application head (1) can be opened while simultaneously releasing and separating the at least one strapping band (15) from its fixed position within the application head (1).

9. The application device (40) of claim 8, wherein the cage (50) comprises one or more fixing apparatus for the strapping band (15).

10. The application device (40) of claim 9, wherein the one or more fixing apparatus comprises clamping elements (3), suction elements (4), vacuum grippers, or adhesion grippers.

11. The application device (40) of claim 8, wherein the cage (50) comprises a contoured guide (51) on its inner circumference, wherein the contoured guide (51) is formed at the corner radii, or wherein the contoured guide is beveled in the lowering direction onto the grouped articles (10).

12. The application device (40) of claim 11, wherein the cage (50) comprises at least one undercut (21) in which the strapping band (15) is arranged after insertion into the cage (50).

13. The application device (40) of claim 8, wherein the cage (50) can be opened by opening movements of individual segments of the cage (50) directed perpendicularly away from the lateral surface of the grouped articles (10).

14. A packaging device for producing packaging units (13), each of which is made of at least two grouped articles (10) that are held together by at least one strapping band (15) and at least one packaging blank (60), comprising an application device (40), wherein the application device (40) comprises a movement or handling area for an application head (1) for cooperation with at least two grouped articles (10) within the movement or handling area, wherein the application head (1) comprises a cage (50) having a variable opening width and a region for inserting at least one pre-assembled closed strapping band (15), wherein the cage (50) can surround the grouped articles (10) on the lateral side, wherein the application head (1) comprises at least one holding means (72) for a packaging blank (60), wherein the application head (1), together with the at least one strapping band (15) fixed therein and the at least one held packaging blank (60), can be fed to the grouped articles (10) located in the movement area by a feeding movement running approximately parallel to longitudinal central axes (L) of the articles (10), wherein the cage (50) of the application head (1) contacts the grouped articles (10) on their lateral sides and at least slightly compresses them, and wherein the cage (50) of the application head (1) can be opened while simultaneously releasing and separating the at least one strapping band (15) from its fixed position within the application head (1).

15. The packaging device of claim 14, further comprising a preparation module (30) that produces closed strapping bands (15), the preparation module (30) comprising:

a magazine with a supply of strapping material in strip form, and a connecting device (33) for connecting free ends of the strapping material in strip form to form a closed strapping band (15).

* * * * *